US007382390B2

(12) United States Patent
Noguchi

(10) Patent No.: US 7,382,390 B2
(45) Date of Patent: Jun. 3, 2008

(54) IMAGE FORMING APPARATUS AND CONTROL METHOD THEREOF HAVING MAIN SCAN LENGTH CORRECTING FEATURE

(75) Inventor: Junichi Noguchi, Suzhou (CN)

(73) Assignee: Canon Kabushiki Kaisha (JP)

( * ) Notice: Subject to any disclaimer, the term of this patent is extended or adjusted under 35 U.S.C. 154(b) by 6 days.

(21) Appl. No.: 11/531,731

(22) Filed: Sep. 14, 2006

(65) Prior Publication Data

US 2007/0057989 A1 Mar. 15, 2007

(30) Foreign Application Priority Data

Sep. 14, 2005 (JP) ..... 2005-267694

(51) Int. Cl.
*B41J 2/435* (2006.01)
*B41J 2/47* (2006.01)

(52) U.S. Cl. ..... 347/234; 347/248

(58) Field of Classification Search ..... 347/229, 347/231–235, 248–250, 116
See application file for complete search history.

(56) References Cited

U.S. PATENT DOCUMENTS 7,129,964 B2 * 10/2006 Akiyama et al. ..... 347/235

FOREIGN PATENT DOCUMENTS

JP 2001-013430 A 1/2001
JP 2004102103 A * 4/2004

* cited by examiner

*Primary Examiner*—Hai C Pham
(74) *Attorney, Agent, or Firm*—Rossi, Kimms & McDowell LLP

(57) ABSTRACT

To detect differences in the main-scanning length of each beam on a photosensitive member, patterns for correction are formed on the photosensitive member using only beams (L1, LN) at both ends among a plurality of beams aligned in a sub-scanning direction. The patterns are transferred onto an intermediate transfer belt and detected with photosensors, a difference ΔLN of scanning length between a 1-st line and a N-th line is calculated, and a difference ΔLi of scanning length of a i-th line is calculated by ΔLi=ΔLN×(i/N−1) so as to proportionally distribute ΔLN to the i-th line. The scanning lengths of lines are respectively corrected to be equal each other using the obtained differences ΔLi of scanning length. Thus, an image forming apparatus and a control method that reduce a decline in image quality, even when scanning incident angles of laser beams onto a photosensitive member differ for each of beams on forming images by scanning a multiple lines with a multiple beams, can be provided.

8 Claims, 26 Drawing Sheets

DIFFERENCES OF METHOD OF CALCULATING SCANNING LENGTH (N BEAMS)

$$Li = \Delta L_N \times \frac{i}{N-1}$$

METHOD OF CALCULATING DIFFERENCES OF SCANNING LENGTH (4 BEAMS)

IMAGE FORMING APPARATUS AND CONTROL METHOD THEREOF HAVING MAIN SCAN LENGTH CORRECTING FEATURE

BACKGROUND OF THE INVENTION

1. Field of the Invention

The present invention relates to a digital copying machine, a facsimile or a laser printer that forms an image using electrophotographic technology, or a digital copying machine that combines these functions. More particularly, the present invention relates to an image forming apparatus that uses a multi-beam technique to form an image by scanning a plurality of lines with a plurality of beams, as well as a control method thereof.

2. Description of the Related Art

Conventionally, an image forming apparatus, which forms an electrostatic latent image on a photosensitive member by an electrophotographic process, using a laser scanning optical system that irradiates light such as laser beam light emitted from a light emitting device onto a drum-shaped electrophotographic photosensitive member as an image carrier, namely a photosensitive drum, is known.

In recent years, improvements in image forming speed and image forming density (resolution) are being sought with respect to this type of image forming apparatus. In response to these demands, an image forming apparatus has been realized in which an image clock for forming each picture element is speeded up in the main-scanning direction, and the rotating speed of a polygon motor is accelerated in the sub-scanning direction.

However, since there is a limit to the degree to which the rotating speed of the polygon motor can be accelerated, as another method of acceleration a multi-beam scanning optical system has been proposed that simultaneously and in parallel scans a plurality of laser beams on a photosensitive member at one scanning. Using this multi-beam scanning optical system, the rate of scanning by laser beams in forming an image on a photosensitive member is given by 1/(number of laser beams).

In a configuration that scans each laser beam on a photosensitive member using a multi-beam optical system, if variations occur in the production process of each optical element affecting their optical properties, the scanning magnifications in the main-scanning direction will not match and the image quality will decline. It is therefore necessary to perform processing to correct this inconsistency and restore the scanning magnifications in the main-scanning direction to be equal.

To solve this problem, it is necessary to allow higher quality images to be formed by making it possible to adjust the laser modulation rate as one parameter that determines scanning magnification in the main-scanning direction separately for each laser, and to scan each beam on the photosensitive member at a constant and equal scanning magnification. Thus, a method (see JPA 2001-013430) has been proposed which corrects the main-scanning magnification by disposing light detecting means (BD sensor: beam detect sensor) at the start point and end point in the main-scanning direction to detect the main-scanning magnification of each beam using the BD sensors and finely adjusting the image clock frequency of each beam.

The problem, in which image deterioration is caused by differences of scanning magnifications in the main-scanning direction due to differences in the scanning incident angle of laser beams in an image forming apparatus using the conventional multi-beam scanning optical system, will now be described with reference to FIGS. 1 to 4. FIG. 1 is a view illustrating a known laser scanning unit. The scanning direction of laser beams (an example of 4 beams is used in the figure) irradiated from unshown laser diodes is determined by a polygon mirror 102 that is rotationally driven at a predetermined rotational frequency by a polygon motor 103 (laser beams 104). These laser beams are controlled so as to scan the surface of a photosensitive drum 101 via a reflection mirror 105.

FIG. 2 is a view showing a part of FIG. 1 as viewed from above. By rotational driving of the polygon mirror in the direction indicated by the arrow in the figure the laser beams are scanned as shown in the figure, and BD sensors 106 and 107 are disposed in the optical path of the laser beams. The BD sensor 106 is disposed at the start point in the laser scanning direction and the BD sensor 107 is disposed at the end point in the laser scanning direction, and they perform detection of main-scanning magnification (detection of difference in scanning length) and output of a synchronizing signal for the main-scanning direction.

In this case, as shown in FIG. 1, if the scanning incident angle θ of the laser beams onto the photosensitive drum 101 is roughly the same for each beam, a decrease in image quality caused by a difference in the scanning incident angles of the laser beam does not occur.

However, as shown in FIG. 3, in an ordinary image forming apparatus, in order to reduce the light returned by reflection from the photosensitive drum, or due to constraints on the image forming apparatus such as miniaturization, the scanning incident angle of the laser beams differs as shown by θ1 and θ2 in the figure. Therefore, although the beams had the correct scanning magnification at the disposition location of the BD sensor, the scanning magnification differs by the difference in the scanning incident angles of the laser beams on the photosensitive drum as shown in FIG. 3. As a result, the scanning lengths of the laser beams on the photosensitive drum 101 differ as shown in FIG. 4.

FIG. 4 is a view illustrating toner images that are formed on the photosensitive member by the four laser scanning beams LD1 to LD 4 shown in FIG. 3. As shown in FIG. 4, these laser scanning beams LD1 to LD 4 produce the differences in the scanning lengths, more specifically, in the lengths of the toner images formed on the photosensitive drum in the scanning direction. When the scanning lengths of the laser beams on the photosensitive drum 101 differ in this manner, vertical line fluctuations and the like occur and thus a problem arises in that image quality may decrease.

SUMMARY OF THE INVENTION

The present invention was made in order to solve the problems of the prior art as described above. An object of the present invention is to provide an image forming apparatus that reduces a decrease in image quality caused when an image is formed by scanning a plurality of lines with a plurality of beams, even when the scanning incident angles of laser beams onto a photosensitive member differ for each beam, as well as a method of controlling the image forming apparatus.

An embodiment of the image forming apparatus according to this invention for achieving the above-described object has the following configuration. That is, the present invention provides an image forming apparatus for forming an image by scanning on a photosensitive member in a main-scanning direction with a plurality of beams aligned in a sub-scanning direction, comprising: a pattern forming unit adapted to form, with beams at both ends in the sub-scanning direction, patterns on the photosensitive member which are used for detecting a difference of scanning length in the main-scanning direction between the beams; a position detection unit adapted to detect positions of a start point and an end point in the main-scanning direction of the patterns on the photosensitive member formed with the beams at both ends; a difference of scanning length calculating unit adapted to calculate a difference of scanning length in the main-scanning direction between the beams at both ends based on the detected positions of the start and end positions on the photosensitive member; a correction amount calculating unit adapted to calculate correction amounts for respectively correcting scanning lengths of the plurality of beams based on the calculated difference of scanning length between the beams at both ends; and a correcting unit adapted to correct scanning lengths of the plurality of beams respectively based on the calculated correction amounts.

The present invention also provides an image forming apparatus for forming an image by scanning a surface of a photosensitive member in a main-scanning direction with surface-emission type beams aligned in a sub-scanning direction and a main-scanning direction, comprising: a pattern forming unit adapted to form, with at least beams at both ends in the sub-scanning direction, patterns on the photosensitive member which are used for detecting a difference of scanning length in the main-scanning direction between the beams; a position detection unit adapted to detect positions of a start point and an end point in the main-scanning direction of the patterns on the photosensitive member formed with the beams at both ends; a difference of scanning length calculating unit adapted to calculate a difference of scanning length in the main-scanning direction between the beams at both ends based on the detected positions of the start and end points on the photosensitive member; a correction amount calculating unit adapted to calculate correction amounts for respectively correcting scanning lengths of the plurality of beams based on the calculated difference of scanning length between the beams at both ends; and a correcting unit adapted to correct scanning lengths of the plurality of beams respectively based on the calculated correction amounts.

Further, a method of controlling an image forming apparatus according to this invention has the following structure. That is, the present invention provides A method of controlling an image forming apparatus that forms an image by scanning on a photosensitive member in a main-scanning direction with a plurality of beams aligned in a sub-scanning direction, comprising the steps of: forming, with beams at both ends in the sub-scanning direction, patterns on the photosensitive member which are used for detecting a difference of scanning length in the main-scanning direction between the beams; detecting positions of a start point and an end point in the main-scanning direction of the patterns on the photosensitive member formed with the beams at both ends; calculating a difference of scanning length in the main-scanning direction between the beams at both ends based on the detected positions of the start and end points on the photosensitive member; calculating correction amounts for respectively correcting scanning lengths of the plurality of beams based on the calculated difference of scanning length between the beams at both ends; and correcting scanning lengths of the plurality of beams respectively based on the calculated correction amounts.

The present invention also provides a method of controlling an image forming apparatus that forms an image by scanning on a photosensitive drum in a main-scanning direction with surface-emission type beams aligned in a sub-scanning direction and a main-scanning direction, comprising the steps of: forming, with at least beams at both ends in the sub-scanning direction, patterns on the photosensitive member which are used for detecting a difference of scanning length in the main-scanning direction between the beams; detecting positions of a start point and an end point in the main-scanning direction of the patterns on the photosensitive member formed with the beams at both ends; calculating a difference of scanning length in the main-scanning direction between the beams at both ends based on the detected positions of the start and end points on the photosensitive member; calculating correction amounts for respectively correcting scanning lengths of the plurality of beams based on the calculated difference of scanning length between the beams at both ends; and correcting scanning lengths of the plurality of beams respectively based on the calculated correction amounts.

According to the present invention, in an image forming apparatus, a difference of scanning length between beams can be corrected using a simple configuration. It is therefore possible to provide an image forming apparatus that reduces a decrease in image quality, even when the scanning incident angles of laser beams onto a photosensitive member differ for each of beams, as well as a control method thereof.

Further features of the present invention will become apparent from the following description of exemplary embodiments with reference to the attached drawings.

DESCRIPTION OF THE EMBODIMENTS

<Features of this Embodiment>

The image forming apparatus according to this embodiment uses only the beams at the two edges in the alignment direction to form patterns for detecting a difference of scanning length between each beam when scanning a plurality of beams on a photosensitive member. The apparatus then detects the positions of the start point and end point of the formed patterns in the scanning direction and calculates a difference ΔL of scanning length between the beams at both edges. Based on the thus calculated differences of scanning length, the apparatus calculates correction amounts for correcting the respective differences of scanning length between each beam to make it possible to correct the differences of scanning length by each of beams. Thus, according to this image forming apparatus, even when the scanning incident angles of laser beams onto a photosensitive member differ for each of beams, it is possible to reduce a decrease in image quality by correcting the differences of scanning length by each of beams that are caused by differences in the scanning incident angles.

<Configuration Example of Image Forming Apparatus of this Embodiment>

Hereunder, the image forming apparatus of one embodiment according to this invention will be described in detail with reference to the attached drawings.

Figure 1:
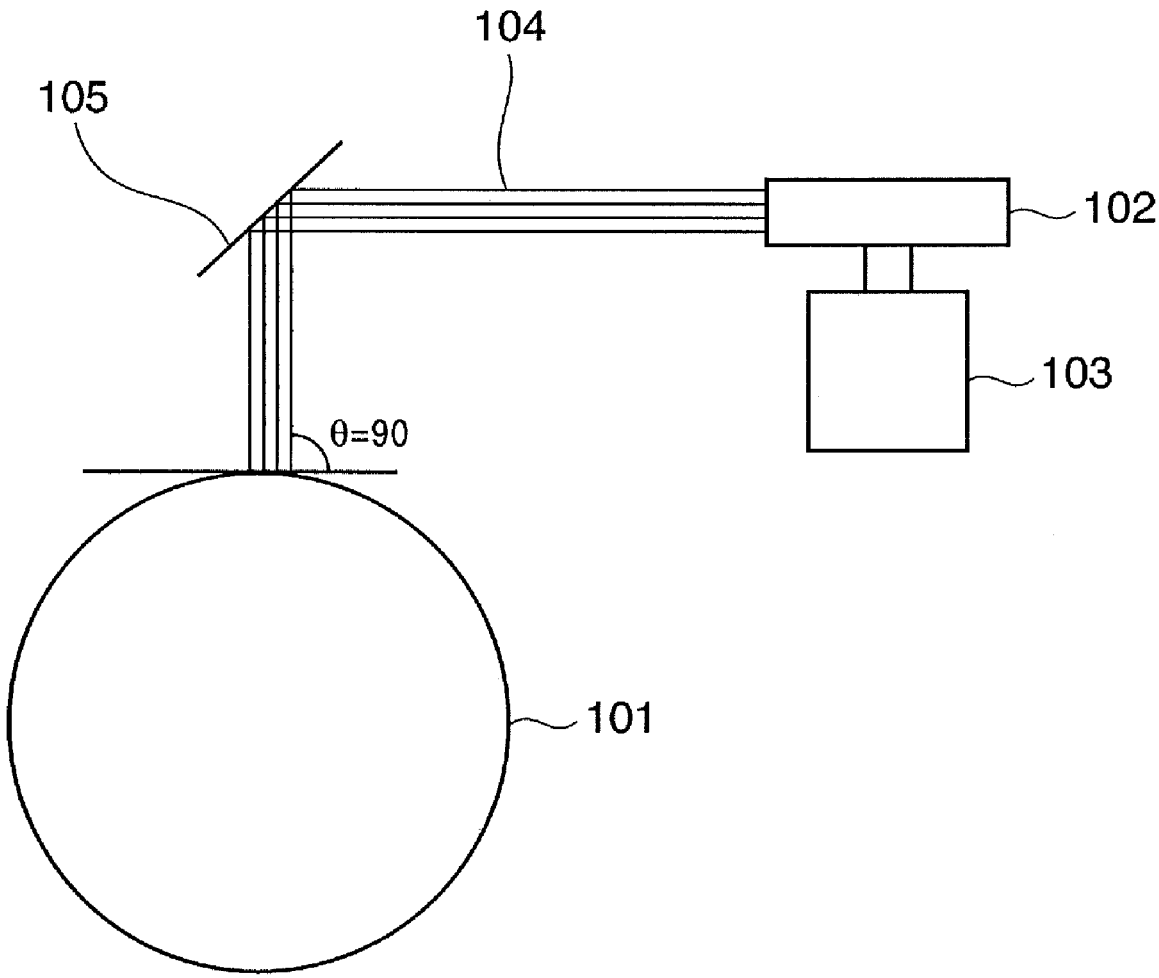
FIG. 1 is a view that illustrates one example of forming a toner image on a photosensitive drum with a conventional laser scanning unit using multiple beams.
Figure 2:
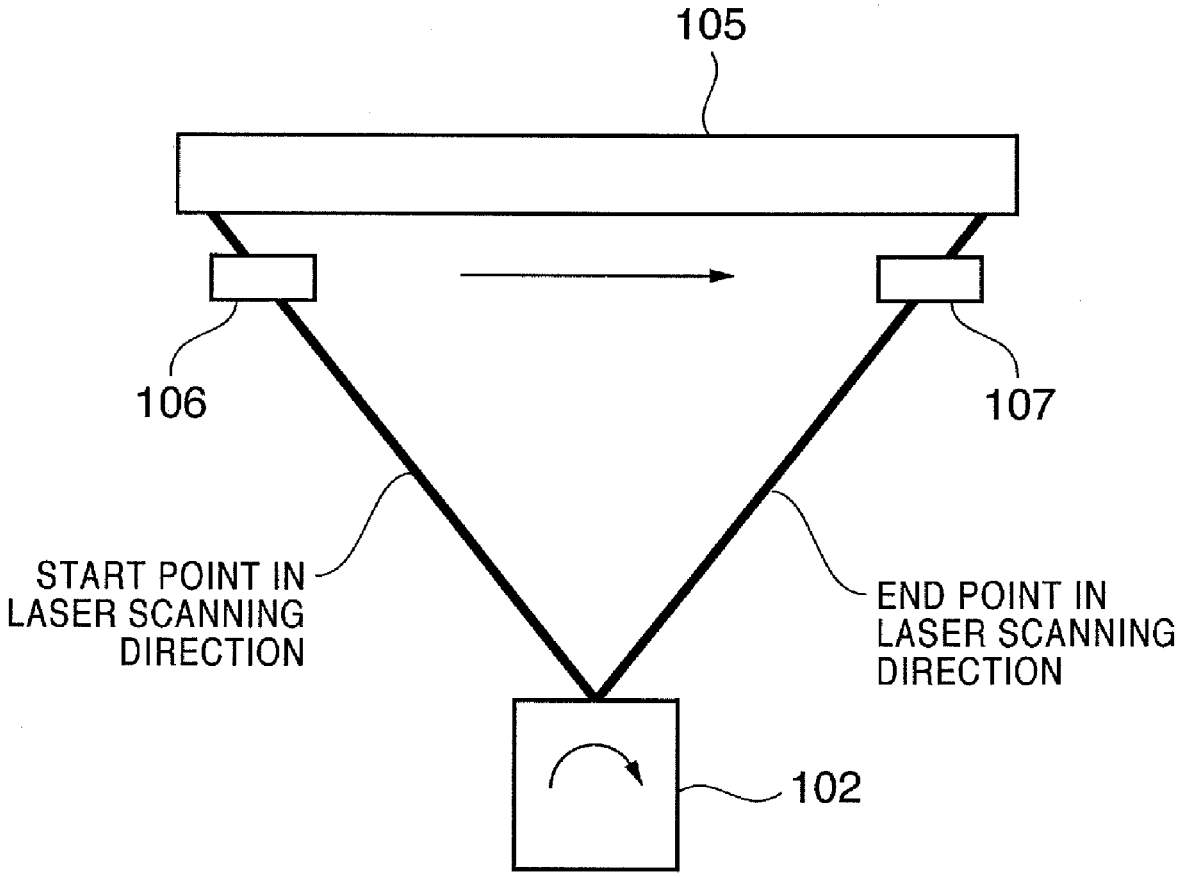
FIG. 2 is a view showing one part of the laser scanning unit shown in FIG. 1 when viewed from above.
Figure 3:
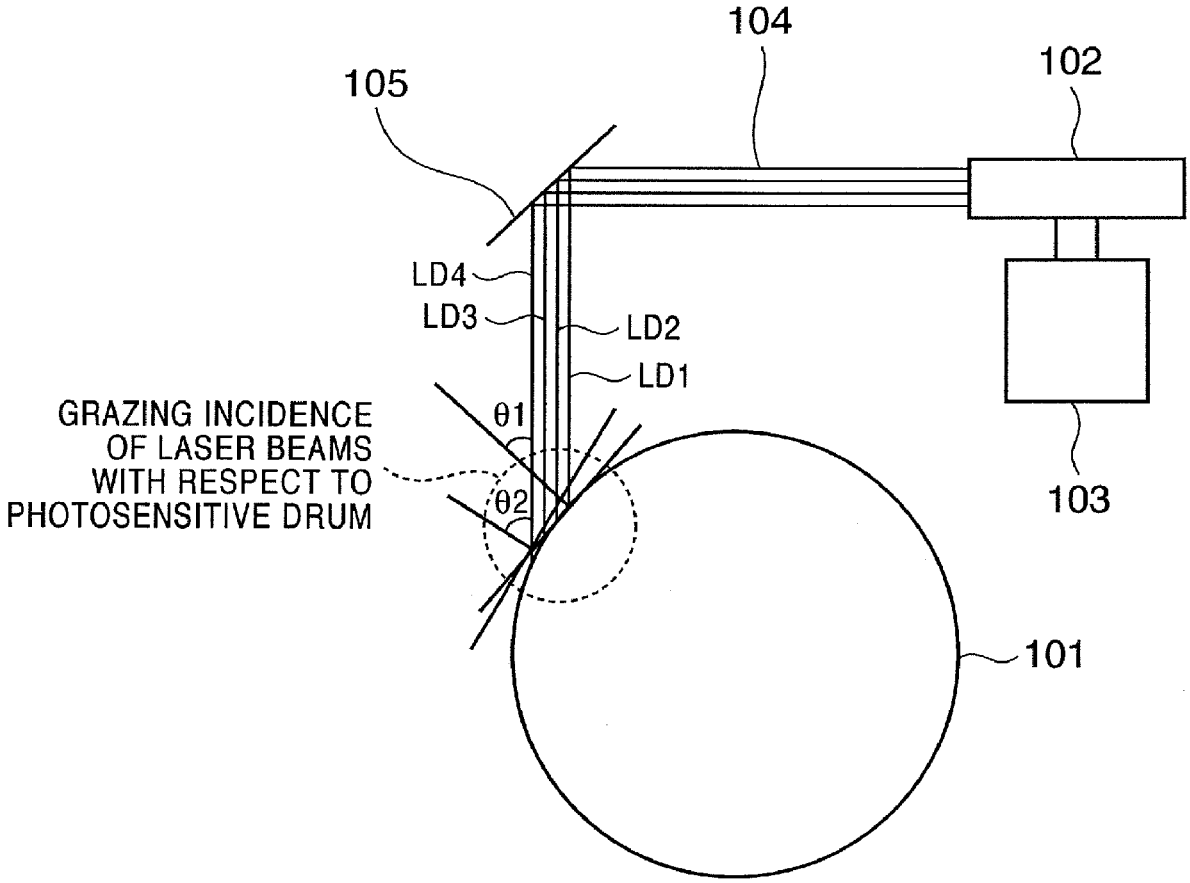
FIG. 3 is a view that illustrates another example of forming a toner image on a photosensitive drum with a conventional laser scanning unit using multiple beams.
Figure 4:
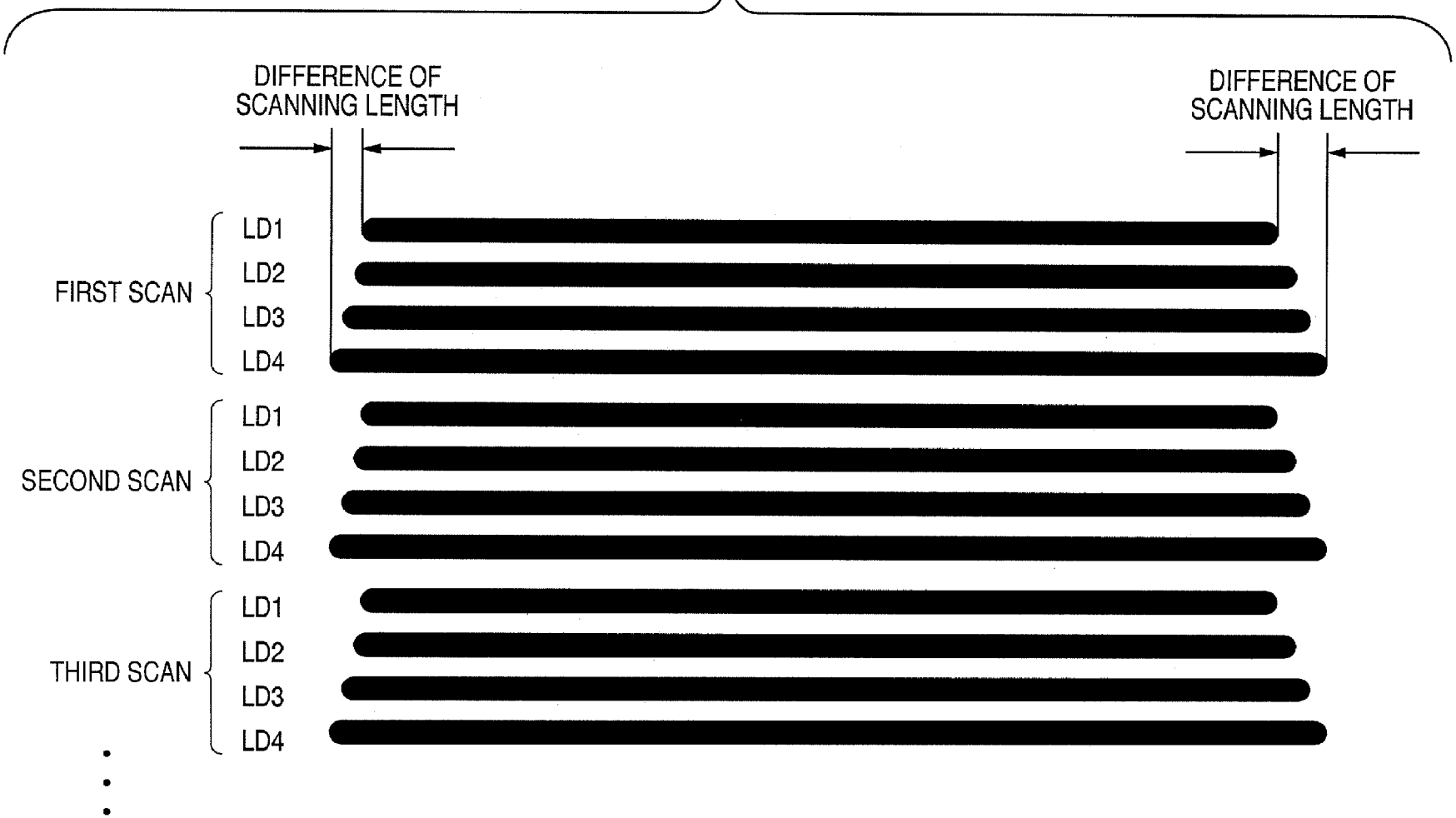
FIG. 4 is a view that illustrates difference of scanning lengths on a photosensitive drum when using four laser beams.
Figure 5:
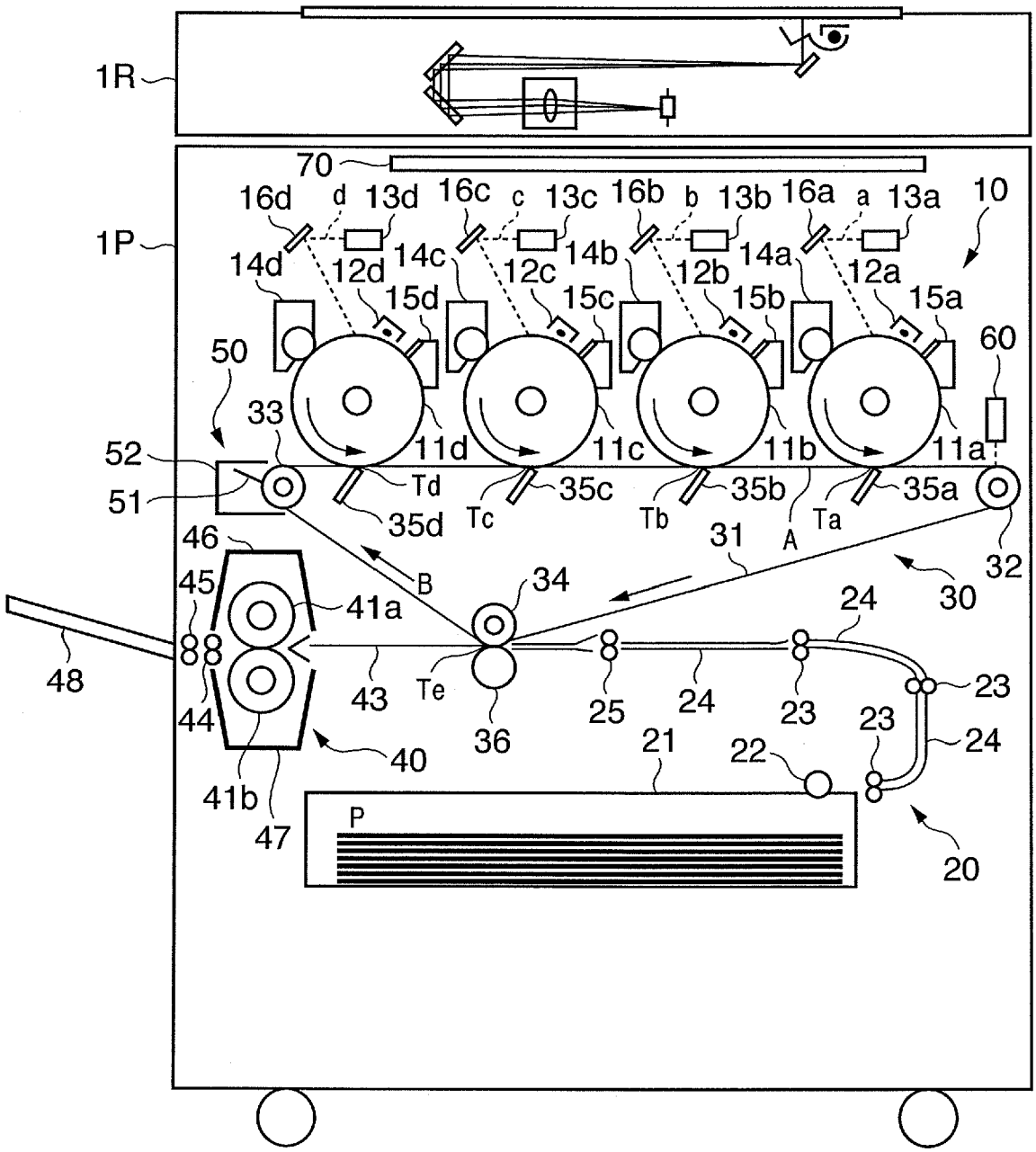
FIG. 5 is a view showing one example of an image forming apparatus according to a first embodiment.

(Cross Section of Principal Portion of Image Forming Apparatus and Operation Example Thereof: FIG. 5)

FIG. 5 is a cross section that shows the principal portion of one example of an image forming apparatus according to the first embodiment of this invention. The image forming apparatus of this embodiment described below operates according to an electrophotographic system. This image forming apparatus is described by taking a color image forming apparatus in which a plurality of image forming units 10 are disposed in parallel and which employs an intermediate transfer system as one example thereof. The present invention is considered to be particularly effective for this type of color image forming apparatus.

The color image forming apparatus comprises an image reading unit 1R and an image output unit 1P. The image reading unit 1R optically reads an original image, converts the thus-read image into an electrical signal and sends the signal to the image output unit 1P. However, a detailed description of the image reading unit 1R is omitted here. The image output unit 1P broadly comprises an image forming unit 10 (four stations a, b, c and d are provided in proximity in a row arrangement, and the configuration of each station is the same), a sheet feeding unit 20, an intermediate transfer unit 30, a fixing unit 40, a cleaning unit 50, a photosensor unit 60, and a control unit 70.

The individual units will now be described in detail. The image forming unit 10 is configured as described hereafter. Photosensitive drums 11*a*, 11*b*, 11*c*, and 11*d* are pivotally supported as image bearing members in the center thereof, and are rotationally driven in the direction indicated by the arrows. Primary charging devices 12*a*, 12*b*, 12*c*, and 12*d*, optical systems 13*a*, 13*b*, 13*c*, and 13*d*, reflection mirrors 16*a*, 16*b*, 16*c*, and 16*d*, and developing portions 14*a*, 14*b*, 14*c*, and 14*d* are disposed facing the peripheral surface of the photosensitive drums 11*a* to 11*d* as a photosensitive member, in the rotational direction thereof. An electrical charge of a uniform charge amount is applied to the surfaces of the photosensitive drums 11*a* to 11*d* by the primary charging devices 12*a* to 12*d*.

Next, light beams such as, for example, laser beams that were modulated in accordance with recording image signals by optical systems 13*a* to 13*d* are exposed on the photosensitive drums 11*a* to 11*d* via reflection mirrors 16*a* to 16*d* to form an electrostatic latent image on each photosensitive drum. These electrostatic latent images are then visualized by the developing portions 14*a* to 14*d* that contain developer (hereunder, referred to as "toner") of the four colors yellow, cyan, magenta and black, respectively. On the downstream side of image transfer regions Ta, Tb, Tc and Td at which the thus-visualized visible images were transferred onto an intermediate transfer member, toner that was not transferred onto the transfer material and remains on the photosensitive drums 11*a* to 11*d* is scraped off by cleaning portions 15*a*, 15*b*, 15*c* and 15*d* to clean the surface of the drums. By the above-described process, image formation by each toner is performed in sequence.

The sheet feeding unit 20 comprises sheet feeding roller pairs 23, a sheet feeding guide 24 and registration rollers 25. The pairs of sheet feeding rollers 23 and the sheet feeding guide 24 convey as far as the registration rollers 25 recording material P that is sent forward from a pickup roller 22 that is provided to send forward the recording material P one sheet at a time from a cassette 21 for containing the recording material P. The registration rollers 25 send the recording material P to a secondary transfer region Te in accordance with the image forming timing of the image forming unit 10.

The intermediate transfer unit 30 will now be described in detail. The intermediate transfer belt 31 is wound around a drive roller 32 that drives the intermediate transfer belt 31, a follower roller 33 that follows the rotation of the intermediate transfer belt 31, and a secondary transfer opposing roller 34 that opposes the secondary transfer region Te by sandwiching the belt therebetween. Among these rollers, a primary transfer plane A is formed between the drive roller 32 and the follower roller 33. The drive roller 32 is formed by coating rubber (urethane or chloroprene) of several mm thickness on the surface of a metal roller to prevent slippage between the roller and the belt. The drive roller 32 is rotationally driven by a pulse motor (not shown).

Primary transfer charging devices 35*a* to 35*d* are disposed on the underside of the intermediate transfer belt 31 at each primary transfer region Ta to Td at which the intermediate transfer belt 31 faces the photosensitive drums 11*a* to 11*d*. A secondary transfer roller 36 is disposed facing the secondary transfer opposing roller 34, so that a secondary transfer region Te is formed by the nip with the intermediate transfer belt 31. The secondary transfer roller 36 is pressurized with a suitable degree of pressure with respect to the intermediate transfer member. On the intermediate transfer belt, a cleaning unit 50 (a blade 51 and a waste toner box 52 for storing waste toner) for cleaning the image forming surface of the intermediate transfer belt 31 is provided downstream of the secondary transfer region Te.

The fixing unit 40 includes a fixing roller 41*a*, a pressure roller 41*b*, a guide 43, fixing unit insulation covers 46 and 47, internal discharge rollers 44, external discharge rollers 45, and a discharge tray 48 for stacking transfer material P. The fixing roller 41*a* comprises an inner heat source such as a halogen heater, and a heat source may also be provided in the pressure roller 41*b* that is pressed against the fixing roller 41*a*. The guide 43 guides the transfer material P to a nip part of the pair of rollers as described above. The fixing unit insulation covers 46 and 47 are provided to confine the heat of the fixing unit within the covers. The internal discharge rollers 44 and external discharge rollers 45 are provided to further guide the transfer material P that was discharged from the aforementioned pair of rollers to outside the apparatus.

A registration (color misregistration) detection sensor 60 reads a pattern image for registration correction or a pattern image for density correction that was formed on the intermediate transfer belt 31. Based on the result, registration (color misregistration) correction and density/gray level correction are performed to enhance image quality.

The control unit 70 includes a CPU (not shown) for controlling the operations of devices within each of the above described units, a ROM (not shown) that stores control programs and various kinds of data, a RAM (not shown), and a motor driver unit (not shown). The CPU carries out various kinds of processing such as correcting the main-scanning magnification, as described in detail later, while controlling various units such as the motor driver unit (not shown) using the RAM (not shown) as an operating region on the basis of a control program.

Next, the operations of the image forming apparatus will be described.

When an image formation operation start signal is issued from the CPU (not shown), first the transfer material P is delivered one sheet at a time from the cassette 21 by the pickup roller 22. The transfer material P is guided along the sheet feeding guide 24 and conveyed as far as the registration rollers 25 by the sheet feeding rollers pairs 23. At that time the registration rollers are stopped and the leading edge of the paper contacts against the nip part. Thereafter, rotation of the registration rollers is started in accordance with the timing at which the image forming unit 10 starts to form an image. The timing of this rotation time is set so that the transfer material P and a toner image that was subjected to primary transfer onto the intermediate transfer belt from the image forming unit 10 meet together exactly at the secondary transfer region Te.

Meanwhile, at the image forming unit 10, when an image formation operation start signal is issued, a toner image is formed on the photosensitive drum 11*d* that is furthest upstream in the rotational direction of the intermediate transfer belt 31 by the aforementioned process. Next, the thus formed toner image that is subjected to primary transfer onto the intermediate transfer belt 31 at the primary transfer region Td by the primary transfer charging device 35*d* to which a high voltage is applied. The toner image that underwent primary transfer is conveyed as far as the next primary transfer region Tc. At that position, image formation is performed and the toner image is delayed for only the amount of time that the toner image is conveyed between each image forming unit 10, and the next toner image is transferred on top of the preceding image in accordance with the registration. The same process is repeated thereafter so that ultimately toner images of four colors are subjected to primary transfer onto the intermediate transfer belt 31.

Thereafter, the recording material P advances to the secondary transfer region Te, and upon contact with the intermediate transfer belt 31 a high voltage is applied to the secondary transfer roller 36 in accordance with the timing at which the recording material P passes that point. The toner images of four colors that were transferred onto the intermediate transfer belt by the aforementioned process are then transferred onto the surface of the recording material P. Subsequently, the recording material P is exactly guided as far as the fixing roller nip portion by the conveying guide 43. The toner image is then fixed onto the surface of the sheet by the heat of the pair of rollers 41*a* and 41*b* and the pressure of the nip. Thereafter, the recording material P is conveyed by the internal and external discharge rollers 44 and 45 to discharge the sheet outside the apparatus to be stacked on the discharge tray 48.

Figure 6:
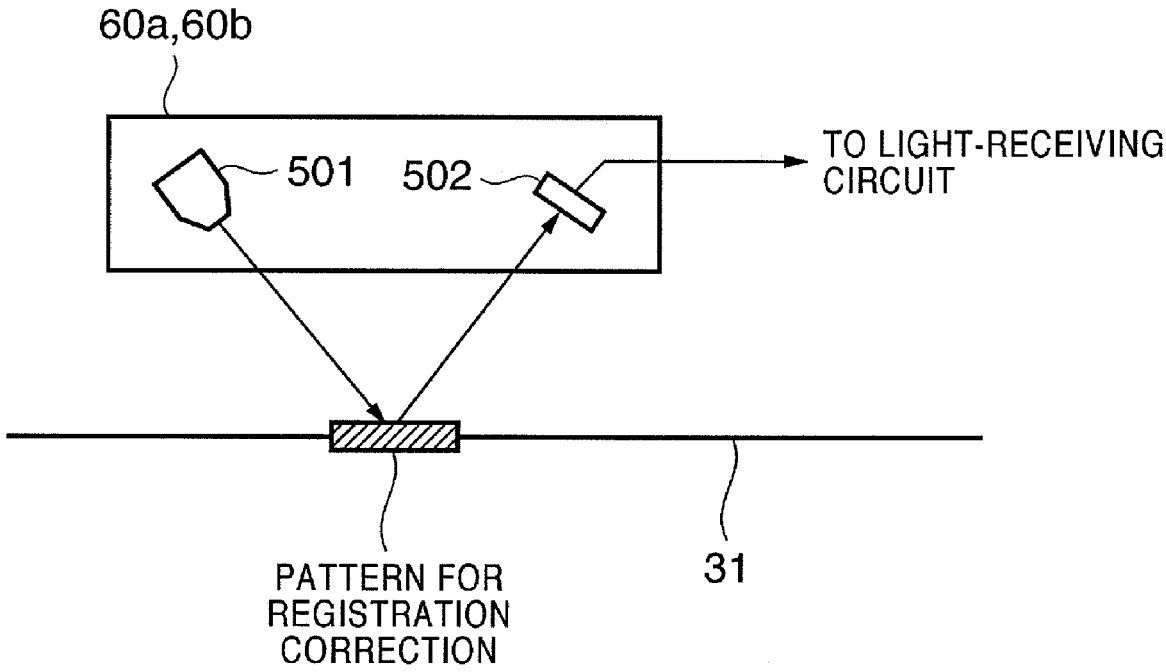
FIG. 6 is a view illustrating one example of a method of detecting a pattern for registration correction that was transferred onto a transfer belt with a photosensor.
Figure 7:
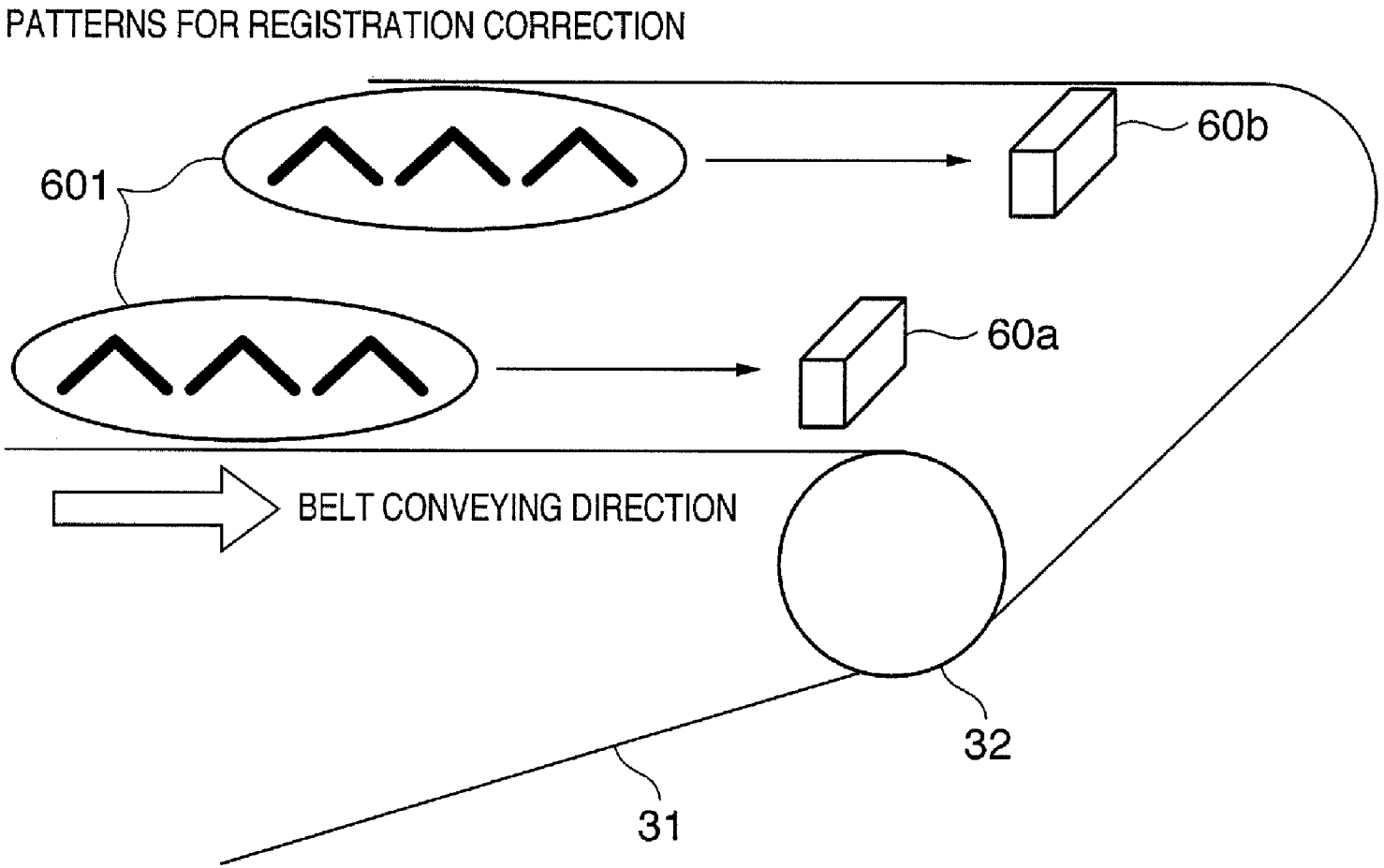
FIG. 7 is a view illustrating a disposition example for two photosensors that are disposed above an intermediate transfer belt.

(Photosensor: FIGS. 6 and 7)

Next, registration correction will be described using FIG. 6 and FIG. 7.

FIG. 6 is a view that illustrates a situation in which photosensors 60*a* and 60*b* for registration correction detect a registration correction pattern on the transfer belt 31.

The photosensors 60*a* and 60*b* for registration correction comprise an LED (light emitting diode) 501 and a PTr (phototransistor) 502. As shown in the figures, the photosensors 60*a* and 60*b* irradiate, for example, an infrared light from the LED 501 onto the transfer belt 31, detect the reflected light from the transfer belt 31 by the PTr 502 and transfer detection signals to an unshown light receiving circuit.

As shown in FIG. 7, the two photosensors 60*a* and 60*b* are disposed in a direction perpendicular to the moving direction of the transfer belt 31, and are positioned between the drive roller 32 and the photosensitive drum 11*a* that is located furthest downstream in the direction of movement of the belt among the plurality of photosensitive drums (see FIG. 5). The photosensors 60*a* and 60*b* for registration correction utilize the difference in the reflectivity of the transfer belt 31 and the registration correction pattern that was formed with toner to read pattern images for registration correction 601 that were formed on the intermediate transfer belt 31.

Figure 8:
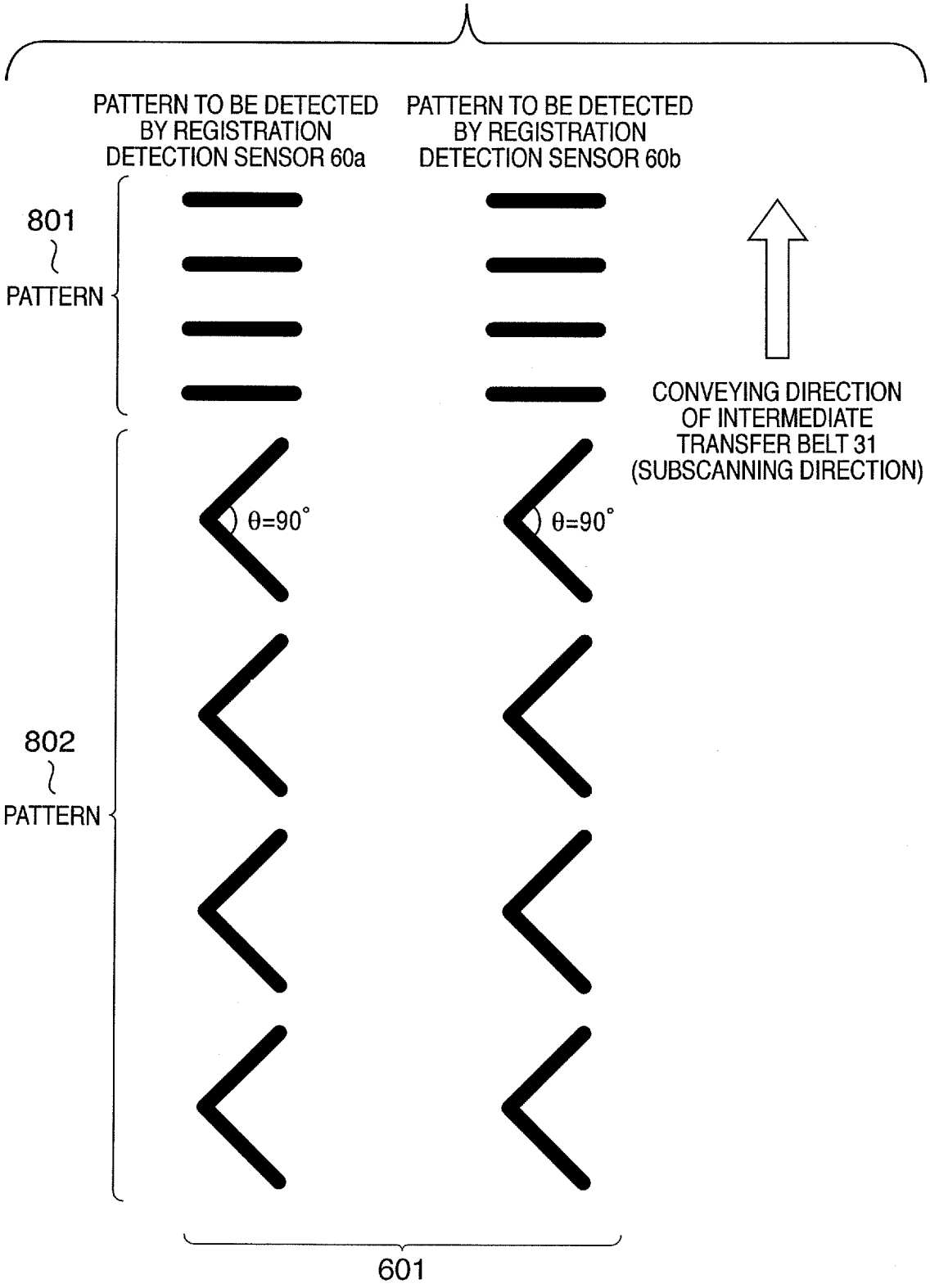
FIG. 8 is a view illustrating one example of a pattern for registration correction.

(Patterns for Registration Correction: FIG. 8)

FIG. 8 shows one example of the patterns for registration correction 601.

The patterns for registration correction 601 consist of a pattern 801 and a pattern 802. The pattern 801 is a pattern for detecting the misregistration amount of the main-scanning inclination and the sub-scanning write start position. The pattern 802 is a pattern for detecting the misregistration amount (difference of scanning length) of the main-scanning magnification and the main-scanning write start position (position of start point). The patterns 801 and 802 are developed with yellow, cyan, magenta and black toner, respectively.

<Example of Registration Correction of Image Forming Apparatus of this Embodiment>

(Example of Procedure for Detecting Difference of Scanning Length of this Embodiment)

Figure 9:
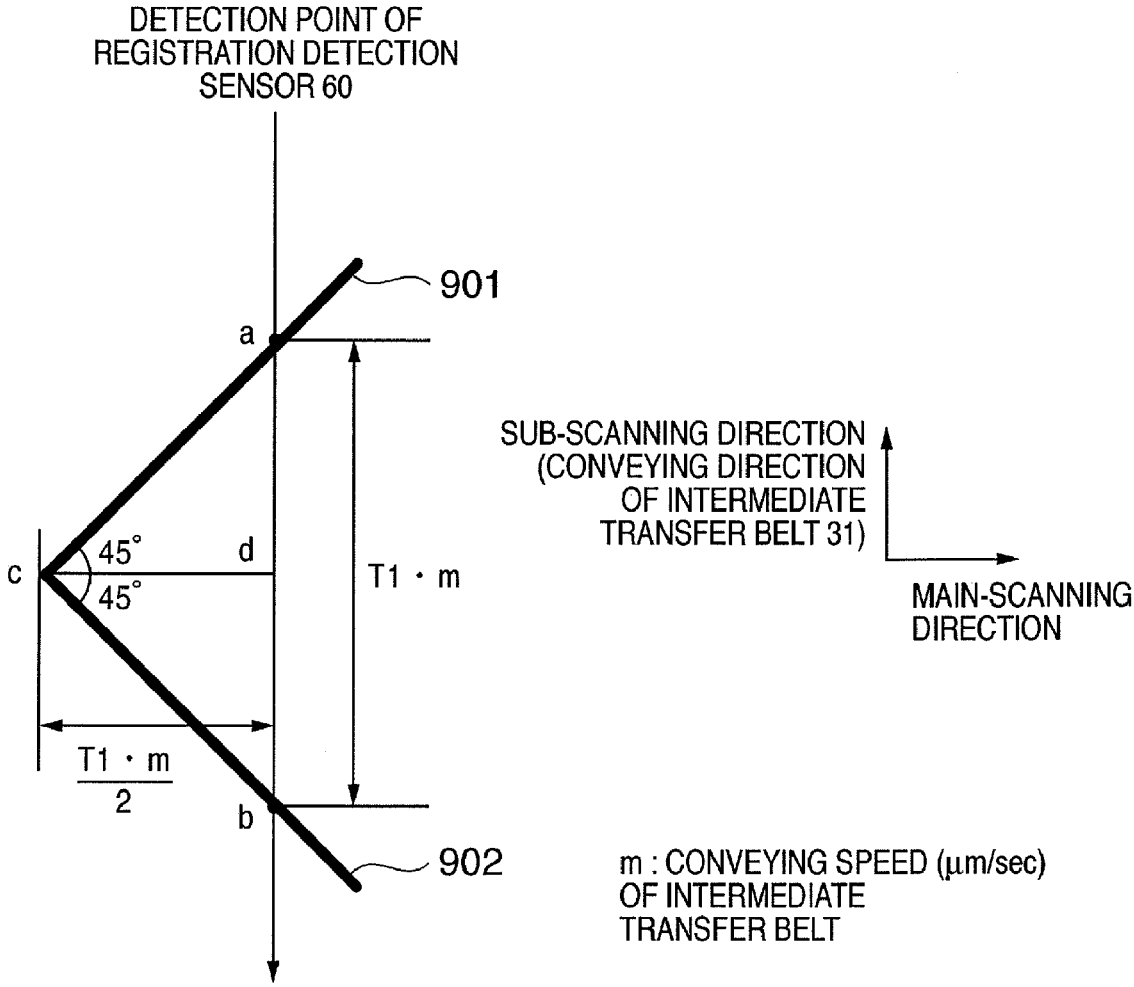
FIG. 9 is a view for explaining the principles for detecting a write start position/write end position in a main-scanning direction.

(Principles for Detecting Write Start Position/Write End Position in Main-scanning Direction: FIG. 9)

Next, the principles for detecting the amount of misregistration in the main-scanning magnification of each color using the patterns for registration correction 601 will be described.

First, using FIG. 9, the principles for detecting the write start position and write end position in the main-scanning direction will be described. As shown in FIG. 9, when the time from detection of a first line segment 901 (point a in the figure) until detection of a second line segment 902 (point b in the figure) is taken as T1 (sec) and the conveying speed of the intermediate transfer belt 31 is taken as m(μm/sec), the length from point a to point b in FIG. 9 is (T1×m) (μm). If the angle between the first line segment 901 and the second line segment 902 is 90 degrees, the distance from the intersection point (point c in the figure) of the first line segment 901 and the second line segment 902 until the position that the sensor passes in the main-scanning direction (point d in the figure) is (T1×m)/2 that is proportionate to (T1×m). If the scanning lengths in the main-scanning direction are different, this value (T1×m)/2 will differ since the positions at which the patterns are formed will be different.

Figure 10A:
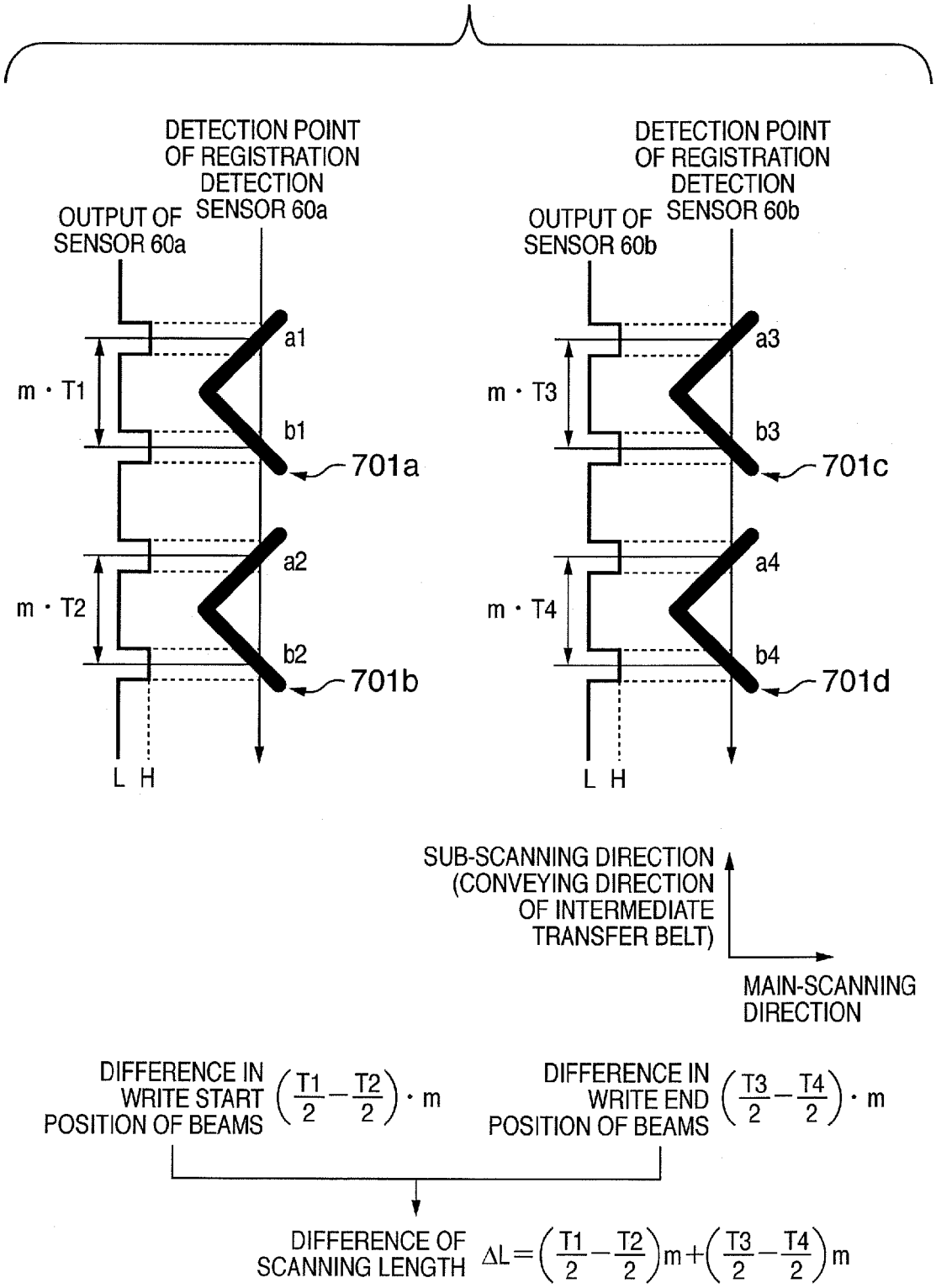
FIG. 10A is a view for explaining patterns for registration correction and sensor output, and the calculation of a difference of main-scanning magnification produced by color misregistration.

(Example of Calculation of Color Misregistration Amount (Difference of Scanning Length) of Main-scanning Magnification: FIG. 10A)

Next, the method of calculating the amount of misregistration in the main-scanning magnification of each color will be described using FIG. 10A.

In FIG. 10A, patterns 701*a* and 701*c* are formed with yellow toner, and patterns 701*b* and 701*d* are formed with magenta. The sensor 60*a* that is disposed at the front side in the main-scanning direction detects the patterns 701*a* and 701*b* through conveyance thereof by the intermediate transfer belt 31. Likewise, the patterns 701*c* and 701*d* are detected by the sensor 60*b*. When the respective sensors detect the patterns 701*a* to 70*d*, they output a detection result as shown in FIG. 10A. With respect to the sensor output, in this embodiment logical "H" is taken as denoting a pattern region and logical "L" is taken as denoting a region outside the pattern, i.e. a substrate region.

As shown in FIG. 10A, when T1 is taken as the elapsed time from a center (position a1) to a center (position b1) of the logical "H" section of pattern 701*a*, the distance from position a1 to position b1 is (T1×m) (μm). Likewise, when the elapsed times until the spaces between the lines of the patterns in the case of patterns 701*b* to 701*d* as shown in FIG. 10A are taken as T2, T3, and T4, the respective distances thereof are (T1×m), (T2×m), (T3×m) and (T4×m).

Accordingly, similarly to FIG. 9, by comparing (T1×m)/2 and (T2×m)/2 it is possible to calculate the difference in the write start position of each beam, and by comparing (T3×m)/2 and (T4×m)/2 it is possible to calculate the difference in the write end position of each beam. Thus, the main-scanning magnification difference (difference of scanning length) of each color can be calculated using expression (1).

$$\Delta L=\{(T1-T2)\times m\}/2+\{(T3-T4)\times m\}/2 \quad (1)$$

In order to cancel driving variations of the motor driving the intermediate transfer belt 31 or the motors driving the photosensitive members and the like, correction precision can be enhanced by reading the patterns for registration correction a plurality of times (for example, 10 times).

(Calculation Example of Misregistration Amount (Difference of Scanning Length) of Main-Scanning Magnification Produced by Multiple Beams: FIG. 10B to FIG. 10E)

Figure 10B:
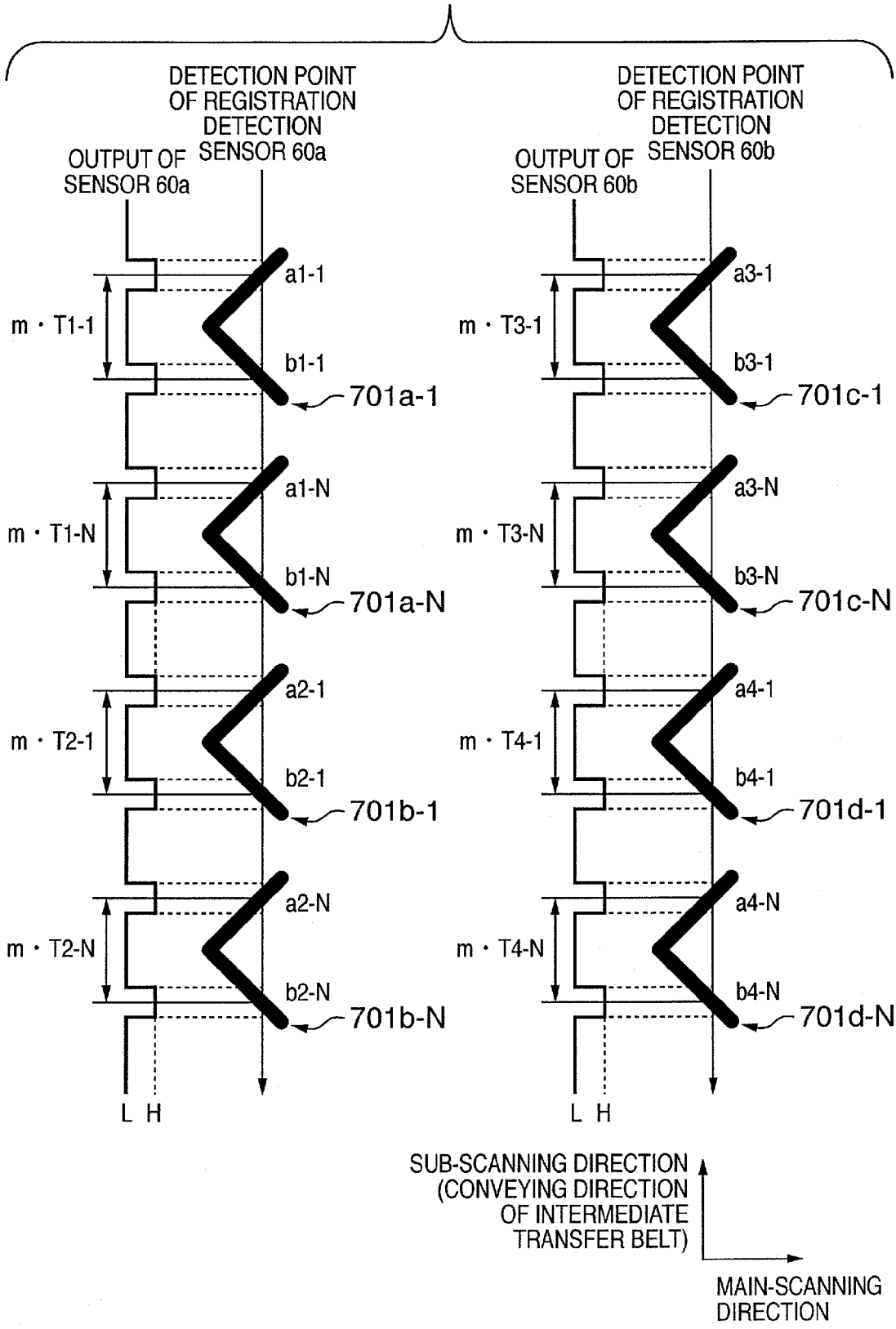
FIG. 10B is a view for explaining one example of a pattern for correcting a difference of main-scanning magnification caused by multiple beams of the first embodiment.
Figure 10C:
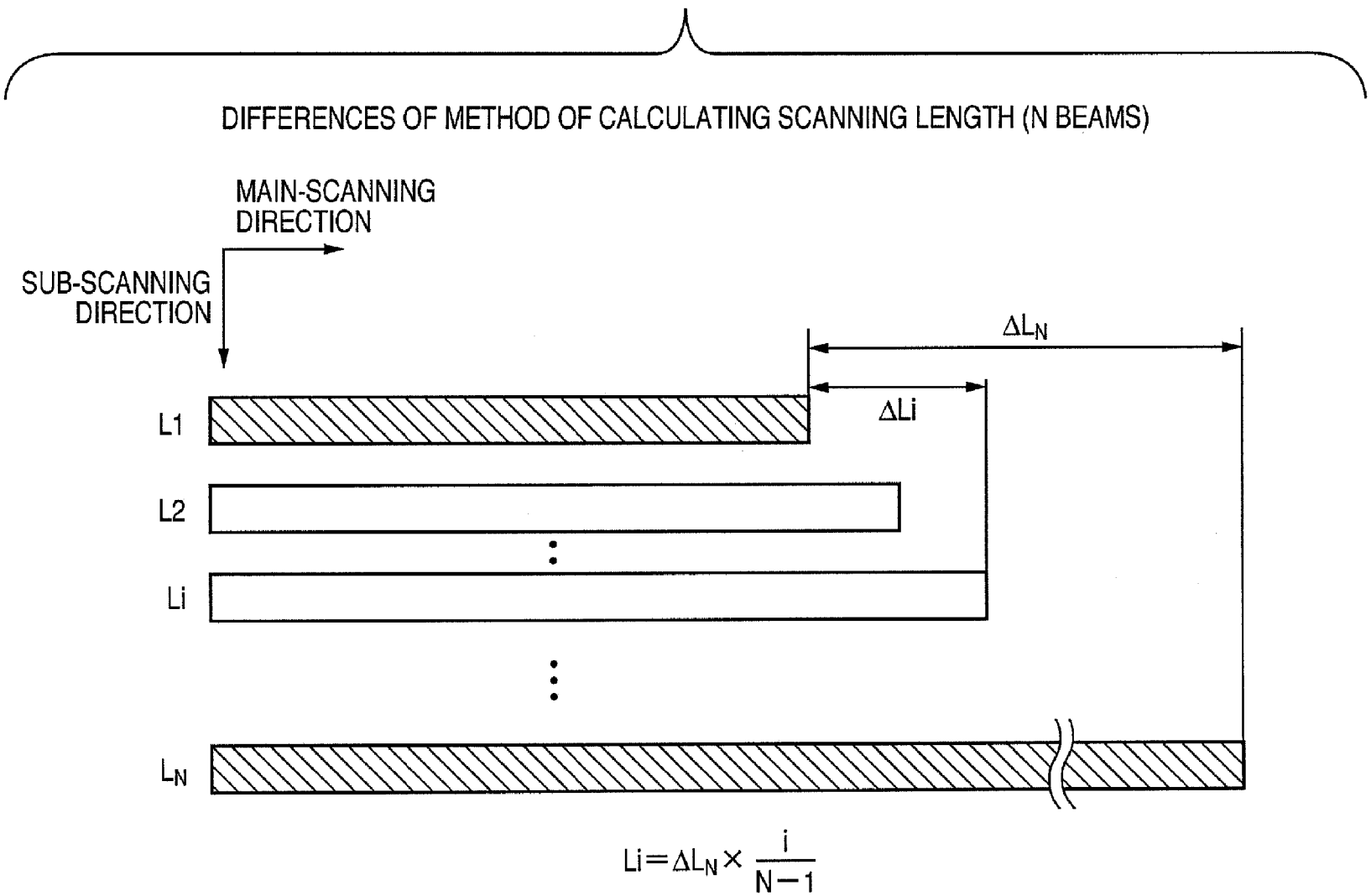
FIG. 10C is a view that illustrates a method of calculating a difference of scanning length in a main-scanning direction using the two beams at both ends among N beams.

Next, a method for conveniently and accurately detecting difference of scanning lengths between each laser beam on a photosensitive drum in an image forming apparatus using N beams as well as a method of correction will be specifically described. FIG. 10B is a view showing one example of the patterns for registration correction used in this embodiment. Although yellow and magenta are shown in FIG. 10B, for example in the case of four colors the patterns of cyan and black will continue thereunder. FIG. 10C is a view for explaining principles for performing difference of scanning length correction in a short time.

When correcting the difference of scanning lengths of multiple beams, the most accurate method is to measure the scanning length formed by each of the N number of multiple beams based on the principles described for the aforementioned color misregistration amount (FIG. 10A) and correct the difference of scanning lengths. However, in this correction method it is necessary to form a pattern for each of the N beams, detect the front end and rear end positions in the scanning direction for each pattern, calculate the difference of scanning length between each beam based on the detected scanning length of each beam, and correct the differences. Thus, a long time is required to form the patterns for each beam, and the amount of toner consumed also increases. There is also the disadvantage that the pattern detection time and correction processing time increase.

Therefore, according to the present image forming apparatus, as shown in FIG. 10B, the formation patterns used in correcting the difference of scanning length for each color are limited to only those of two beams consisting of the beam L1 (first line) and beam LN (N-th line) that are positioned at the two edges of the beams aligned in the sub-scanning direction among the N beams. Next, the start point and end point in the main-scanning direction of the patterns formed by beams L1 and LN are detected by the photosensors and the difference of scanning length ΔLN between the first line and the N-th line that is shown schematically in FIG. 10C is calculated according to the above described expression (1). In this connection, in FIG. 10C, in order to show a distinct difference in the main-scanning lengths, the edges on the left side of the figure have been depicted as matching. Further, the difference of scanning length ΔLi of the Li line is calculated, for example, from the following expression (2) by proportionally distributing ΔLN, without forming a pattern for the Li line:

$$\Delta Li=(\Delta LN\times i)/(N-1) \quad (2)$$

As a result, the pattern formation time can be reduced, the amount of consumed toner can be decreased, and the time for detecting patterns and performing correction processing can also be reduced. It is thus possible to simply and accurately implement a method of correcting difference of scanning lengths.

According to this embodiment, pattern images for registration correction 601 are formed by multiple beams as described above on the intermediate transfer belt 31 at a predetermined timing prior to performing an image formation operation. Subsequently, the pattern images 601 that were formed are read with the photosensors 60*a* and 60*b* for registration correction. Thereafter, registration variations on the photosensitive drums corresponding to each beam are detected based on the read images and correction amounts are calculated based on the detection results. Finally, an electrical correction is applied to image signals to be recorded on the basis of the obtained correction amounts, and/or the reflection mirror 16*a* provided in the optical path of the laser beam is driven to perform a correction consisting of a change in the optical path length or a change in the optical path.

In this connection, misregistrations are detected at the same time on the intermediate transfer members corresponding to the respective colors, correction amounts are calculated, and the misregistration in image formation between each color is also corrected based on the obtained correction amounts.

<Configuration and Operation Example of Registration Correction Value Calculating Unit of this Embodiment>

Figure 10D:
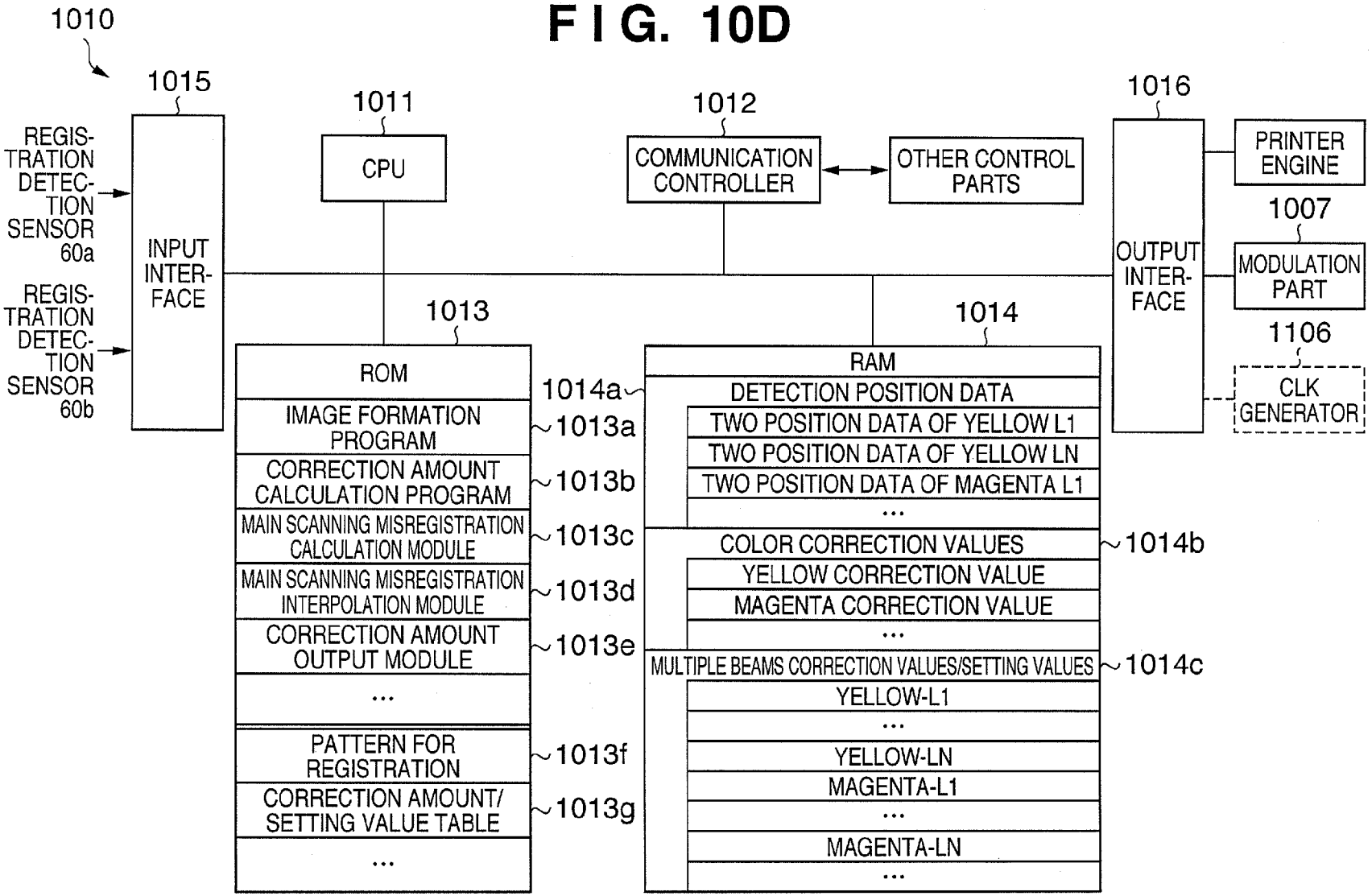
FIG. 10D is a block diagram showing an example of the hardware configuration of the first embodiment including a correction amount calculating unit 1010 shown in FIG. 13.

FIG. 10D is a block diagram showing an example of the hardware configuration of a registration correction value calculating unit (corresponds to correction value calculating unit 1010 of FIG. 13 as described later) of this embodiment. Only components relating to this embodiment are illustrated in FIG. 10D, and other general components are omitted.

In FIG. 10D, reference numeral 1011 denotes a CPU for arithmetic control. Reference numeral 1012 denotes a communication controller for controlling communication with other control units.

Reference numeral 1013 denotes a ROM that stores programs to be executed by the CPU 1011 and fixed data. Parameters or the programs described hereunder relating to this embodiment are stored in the ROM 1013. Reference numeral 1013*a* denotes an image formation program relating to the image forming apparatus of this embodiment. Reference numeral 1013*b* denotes a correction amount calculation program that executes the processing of the correction value calculating unit 1010 of this embodiment. The correction amount calculation program 1013*b* includes a main-scanning misregistration calculation module 1013*c* that calculates a main-scanning misregistration based on detection of the above described patterns by the registration sensors 60*a* and 60*b*. It also includes a main-scanning misregistration interpolation module 1013*d* that performs an interpolation operation for a misregistration of an intermediate beam based on the misregistration between the beams at both edges in the sub-scanning direction of the multiple beams. It further includes a correction amount output module 1013*e* that outputs a control setting value corresponding to a correction value of each beam. Reference numeral 1013*f* denotes a pattern for registration of FIG. 10B. Reference numeral 1013*g* denotes a table for converting the calculated correction amount of each beam into a control setting value. The relationship between a correction amount (length of misregistration) and a control setting value (in this example, a count value of the modulation unit 1007) is specific to each apparatus and is set in accordance with each apparatus.

Reference numeral 1014 denotes a RAM for temporary storage that is used for arithmetic control while the CPU 1011 is executing a program. In the RAM 1014, storage areas are reserved for the following data relating to this embodiment.

Reference numeral 1014*a* denotes a storage area for positional data of beams L1 and LN of each color that is calculated from detection data for the above described patterns of registration sensors 60*a* and 60*b*. Reference numeral 1014*b* denotes an area for storing control values for correcting misregistrations between each color. Reference numeral 1014*c* denotes an area for storing a control value of each of the multiple beams of this embodiment as well as the control setting value thereof.

Reference numeral 1015 denotes an input interface for inputting data relating to this embodiment. In this embodiment, the above described pattern detection data of the registration sensors 60*a* and 60*b* is input through the input interface 1015. Reference numeral 1016 denotes an output interface for outputting data relating to this embodiment. In this embodiment, a pattern for registration is output to a printer engine via the input interface 1015, and setting values for each correction of the multiple beams are output to the modulation unit 1007. In Embodiment 2, adjustment values are output to a CLK generator 1106.

Figure 10E:
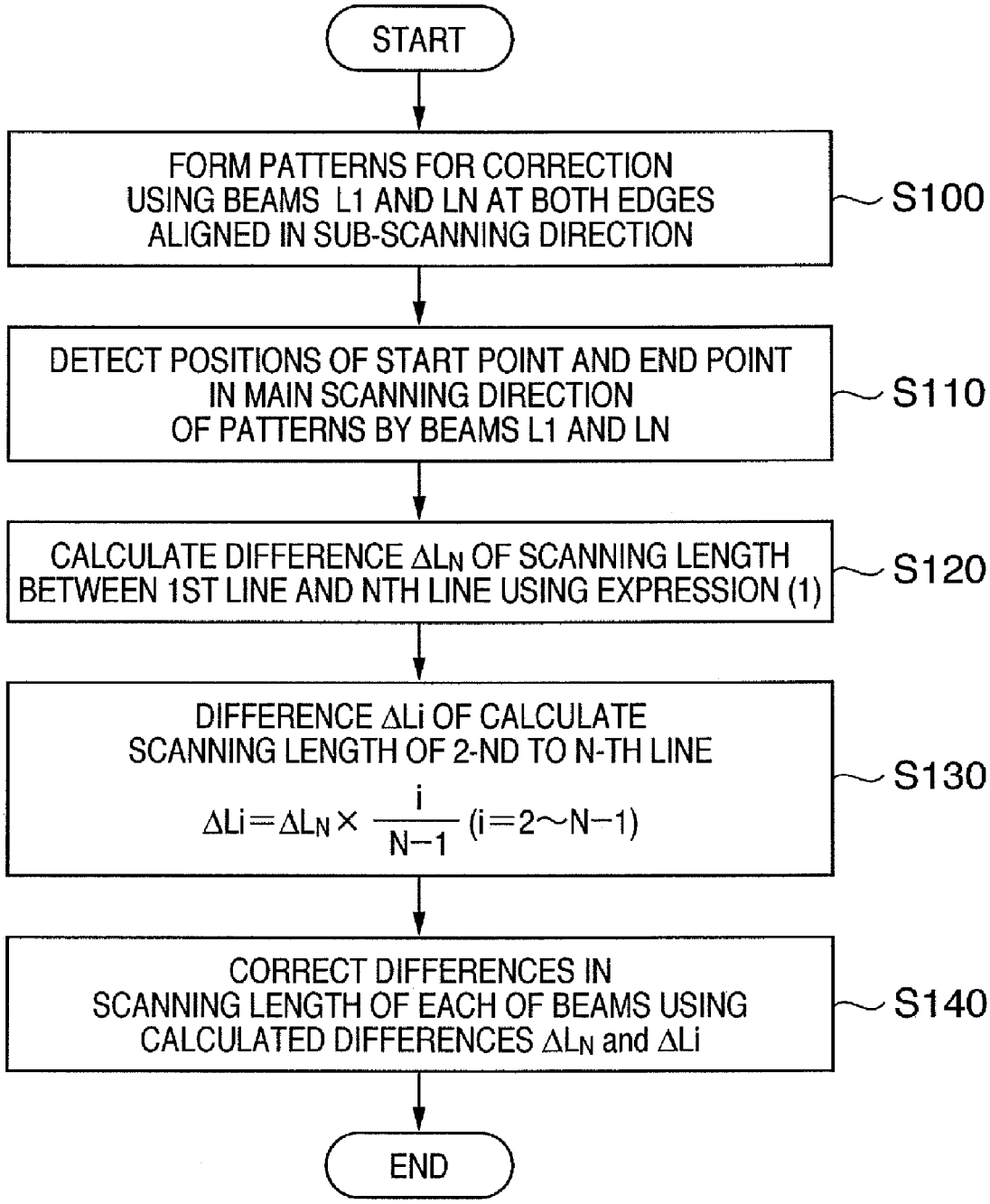
FIG. 10E is a flowchart illustrating a process to correct differences of scanning lengths among multiple beams.

Hereunder, a flowchart illustrating the above described correction processing (corresponds to the correction amount calculation program 1013*b*) for misregistrations between multiple beams of this embodiment as shown in FIG. 10E is described.

Using the flowchart shown in FIG. 10C, a method of correcting difference of scanning lengths according to the present image forming apparatus will be described. This processing is executed by a control program that is stored on the ROM 1013 that controls each unit while using the RAM 1014 as a work area.

First, in step S100, in the case of using multiple beams of a number N, a pattern for correction (FIG. 10 B) is formed on a photosensitive drum using the beams L1 and LN that are for only the first line and the N-th line located at the two edges of the beams aligned in the sub-scanning direction.

Next, in step S110, the positions of start point and end point in the main-scanning direction (see FIG. 9) of the patterns of beams L1 and LN that were transferred onto the intermediate transfer belt 31 are detected with photosensors.

In step S120, the difference ΔLN of scanning length between the first line and the N-th line is calculated using expression (1) based on the thus-detected front end and rear end positions in the main-scanning direction of the patterns of beams L1 and LN.

Subsequently, in step S130, the difference ΔLN that was calculated in step S120 is proportionally distributed using the following expression to calculate the difference ΔLi of scanning length of the i-th line:

$$\Delta Li=(\Delta LN\times i)/(N-1)$$

In step S140, the difference of scanning length of each beam is corrected using the calculated difference ΔLi of scanning length. In this case, the control value is converted to a suitable setting value and output.

Figure 10F:
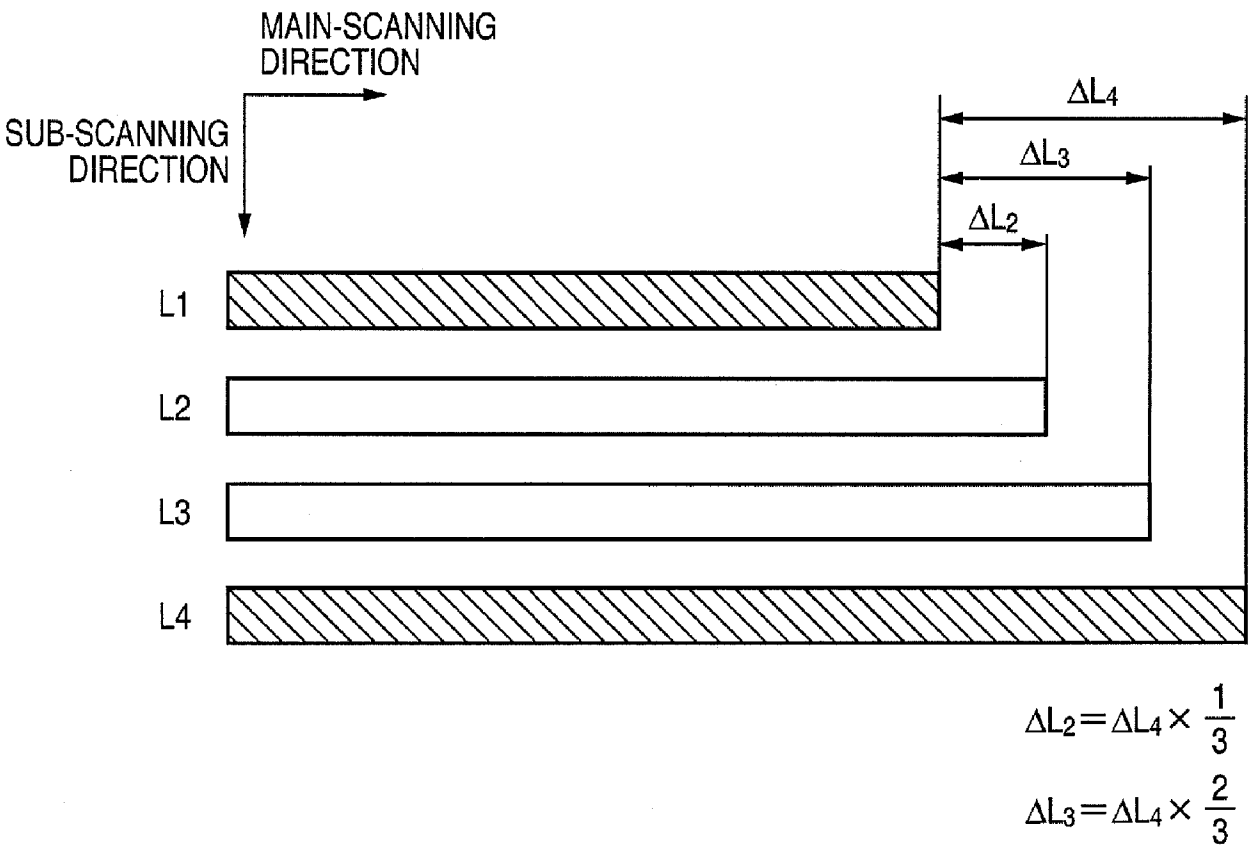
FIG. 10F is a view that illustrates a method of calculating a difference of scanning length in a main-scanning direction using the two beams at both ends among four beams.

(Example Using Four Beams: FIG. 10F)

When using a total number of four beams, as shown in FIG. 10F the patterns of only the first line by beam L1 and the fourth line by beam L4 are formed on the photosensitive drum. Next, the positions of start point and end point in the main-scanning direction (see FIG. 9) of the patterns of beams L1 and L4 that were transferred onto the intermediate transfer belt 31 are detected with photosensors. As a result, since the difference ΔL4 can be calculated using expression (1) and the differences ΔL2 and ΔL3 of scanning length of the 2-nd line and 3-rd line can be calculated using the following expressions, the difference of scanning lengths can be corrected using these values.

$$\Delta L2=\Delta L4\times(1/3)$$

$$\Delta L3=\Delta L4\times(2/3)$$

Figure 11:
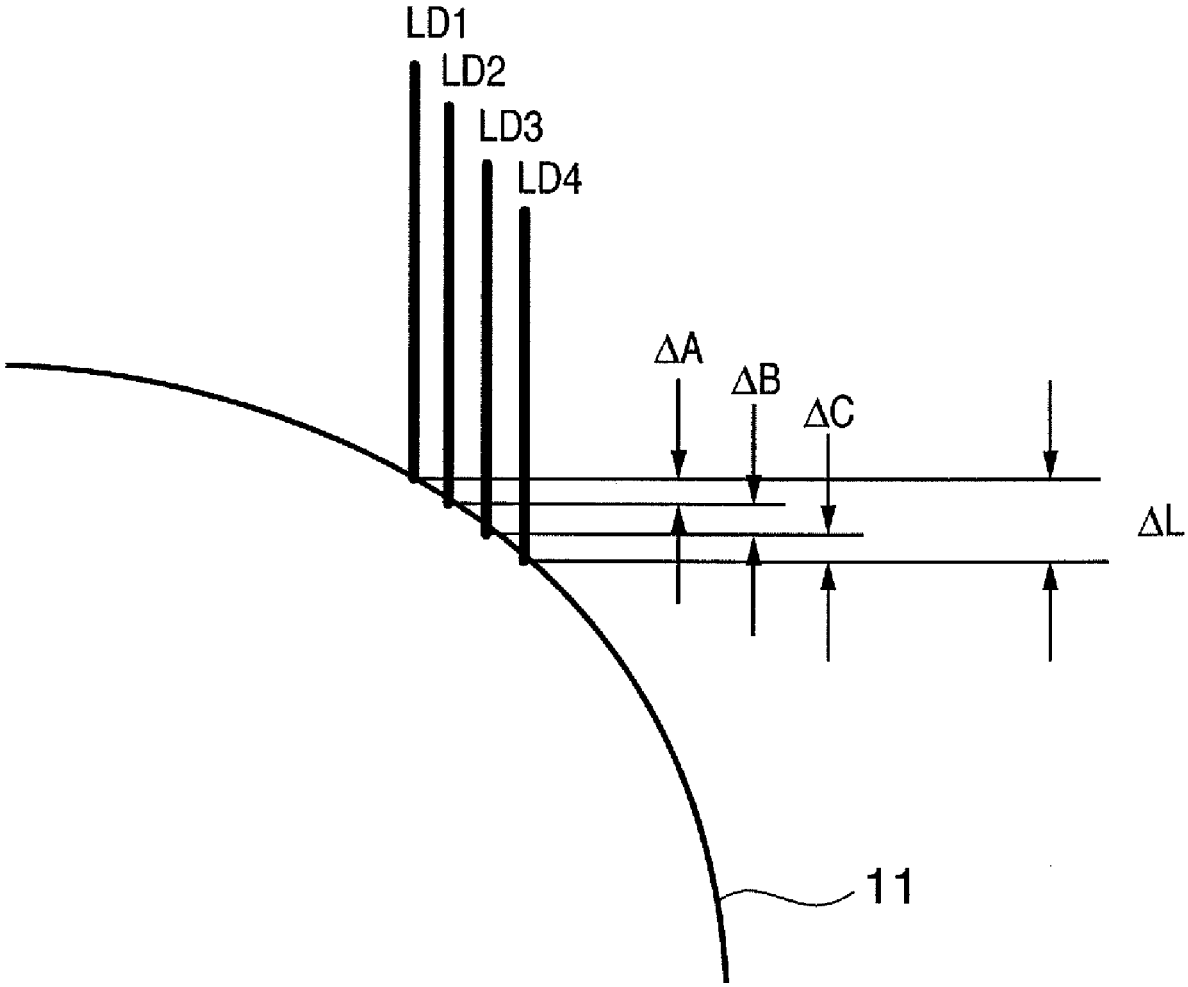
FIG. 11 is a view that illustrates the configuration of a processing unit for correcting differences of scanning length on a photosensitive drum when using four laser beams.

(Description of Method of Calculating Difference of Scanning Length of this Embodiment: FIG. 11)

The method of detecting difference of scanning lengths on a photosensitive member produced by multiple beams as described above will now be explained in detail taking a case of using four beams as an example. A pattern that is the same shape as the pattern for main-scanning magnification correction of each color is used as a pattern for detecting main-difference of scanning lengths between laser beams. This pattern is formed with the respective laser beams LD1 and LD4 for detecting the respective main-difference of scanning lengths of the laser beams at both edges (LD1 and LD4). When forming the pattern, by making the formation speed (rotating speed of photosensitive drum and conveying speed of intermediate transfer belt) in the sub-scanning direction 1/(number of beams), a resolution in the sub-scanning direction can be obtained that is the same as that at a time of normal image formation. Since this embodiment uses four beams, the formation speed in the sub-scanning direction is ¼. The main-difference of scanning length after pattern detection can be calculated by the same calculation as the main-scanning magnification error between each color.

As shown in FIG. 11, laser beams LD1 to LD4 to be irradiated onto a photosensitive drum are irradiated onto a photosensitive drum 11 with a minute space between each beam (for example, in the case of a 600 dpi resolution the space is 42.3 μm). These spaces represent the main-difference of scanning lengths of LD1 to LD4. In this case, if the angle of incidence is not large (less than 45 degrees) the differences in the optical path length (ΔA, ΔB, ΔC) between adjacent beams are roughly equal. Thus, if the main-difference of scanning length between LD1 and LD4 is taken as ΔL, the main-difference of scanning lengths between LD1 and LD2, LD2 and LD3, and LD3 and LD4 are roughly ΔL/3, respectively. When the angle of incidence is large (45 degrees or more), the main-difference of scanning lengths can be calculated based on the relationship between the diameter of the photosensitive drum, the angle of incidence, and the space between laser beams, or by using predetermined tables.

<Example of Configuration Implementing Correction of Main-difference of Scanning Lengths of Image Forming Apparatus According to this Embodiment>

Next, a method of correcting main-difference of scanning lengths among multiple laser beams using the main-difference of scanning lengths that were calculated according to the above described method is specifically described.

Figure 13:
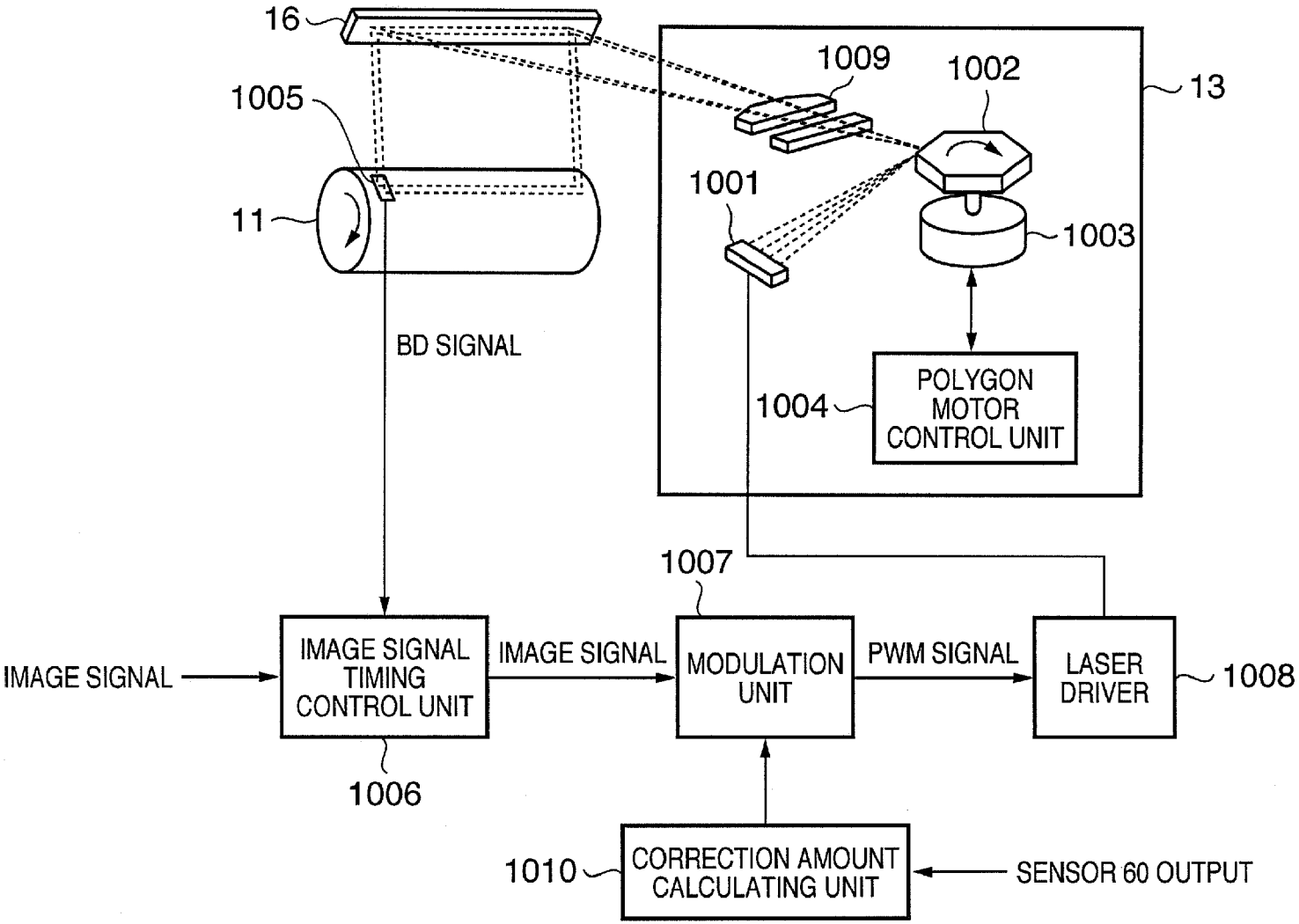
FIG. 13 is a block diagram of a laser control unit that corrects differences of main-scanning length among beams.

<Configuration Example of Laser Control Unit of Image Forming Apparatus of this Embodiment: FIG. 13>

FIG. 13 is a block diagram showing one example of the configuration of a laser control unit used to correct main-difference of scanning lengths among laser beams. Hereunder, each component is described in order. In this connection, the correction amount calculating unit 1010 was described previously referring to FIG. 10D.

(Optical System 13)

An optical system 13 comprises four laser diodes 1001, a polygon mirror 1002, a polygon motor 1003, a polygon motor control unit 1004, and an f-θ lens 1009. Laser beams irradiated from the laser diode 1001 are scanned by the polygon mirror 1002 that rotates in the direction indicated by the arrow in the figure by means of the polygon motor 1003 that drives rotationally. The laser beams are then subjected to known f-θ correction by the f-θ lens 1009 and irradiated onto the photosensitive drum 11 via a reflection mirror 16. The polygon motor control unit 1004 is a control unit for precisely rotating the polygon motor 1003 with a predetermined rotation. A BD sensor 1005 is provided near a scanning start position of line 1 of the laser beams. The BD sensor 1005 detects line scanning (BD signals) of the laser beams and the signals are inputted to an image signal timing control unit 1006.

Figure 14:
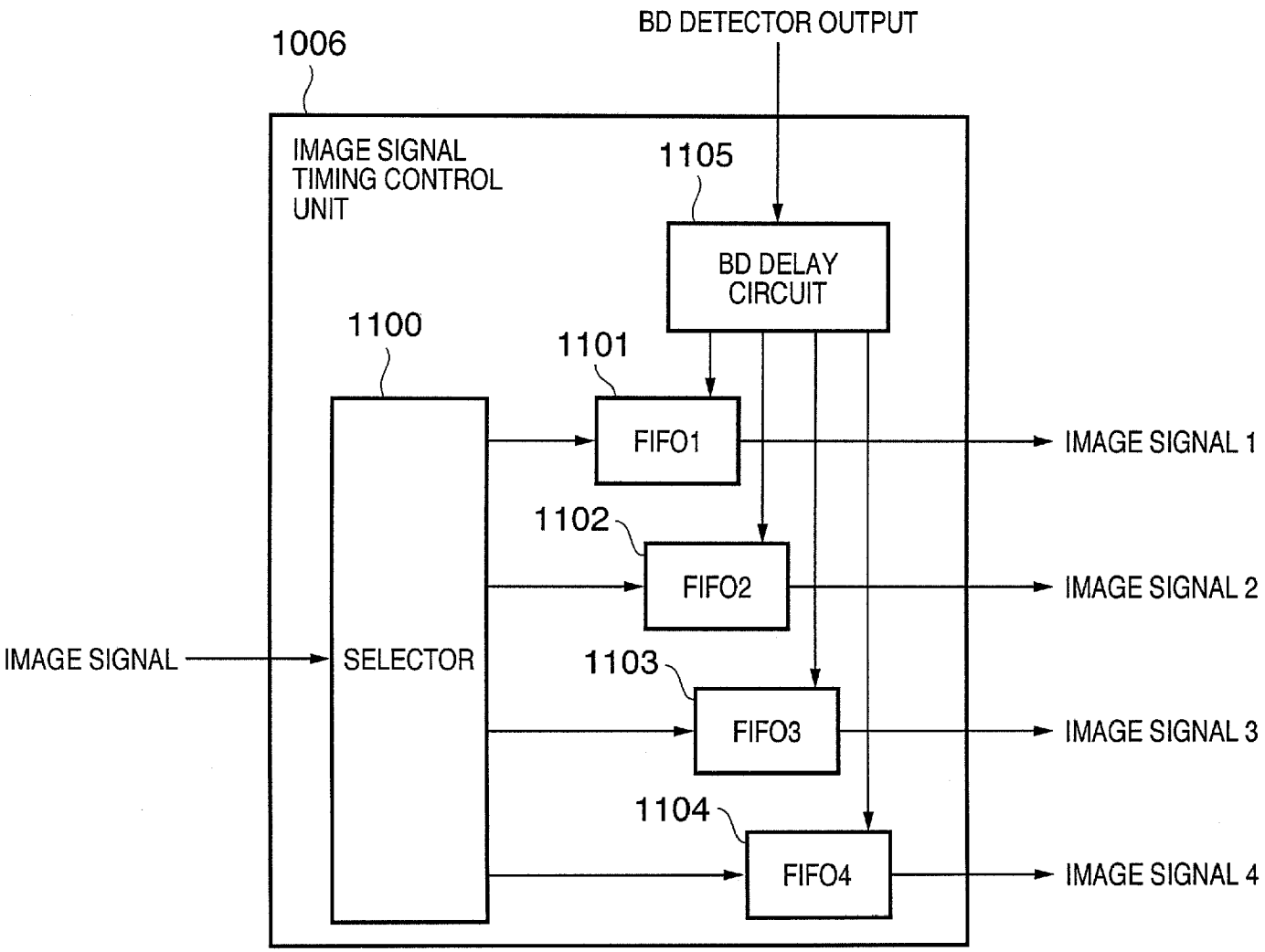
FIG. 14 is a block diagram of an image signal timing control unit.

(Image Signal Timing Control Unit 1006: FIG. 14)

The image signal timing control unit 1006 is illustrated in detail in FIG. 14.

As shown in FIG. 14, the image signal timing control unit 1006 includes a selector 1100, FIFOs (First In First Out memories) 1101 to 1104, and a BD delay circuit 1105. Image signals are input into the selector 1100, the input image signals are changed over for each single line, and then input into the FIFOs (First In First Out memory) 1101 to 1104. The BD delay circuit 1105 delays incorporation of output of the BD sensor 1005 in accordance with the main-scanning write start timing of each laser diode for BD signals that are sent from the BD sensor 1005. The length of this delay is determined in accordance with the amount of misregistration in the physical position in the main-scanning direction on the photosensitive drum 11 of the four laser beams. The FIFOs 1101 to 1104 are line memories that output image data corresponding to four laser diodes input from an unshown image signal generating unit to the modulation unit 1007 based on timing signals from the BD delay circuit 1100.

Figure 15:
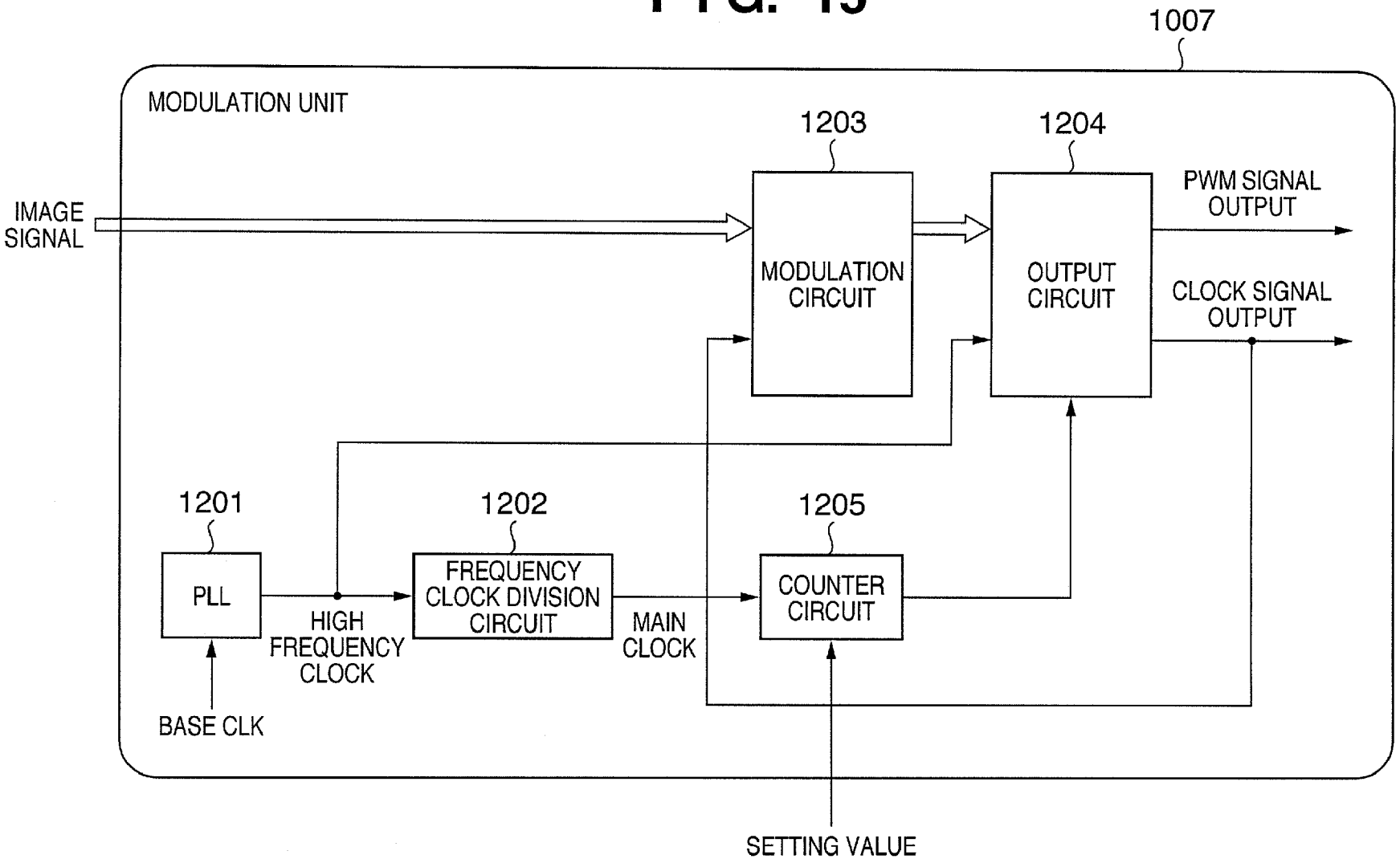
FIG. 15 is a block diagram of a modulation unit.

(Modulation Unit 1007: FIG. 15)

Meanwhile, in FIG. 13, the pattern detection output from the sensor 60 is input to the correction amount calculating unit 1010, and the main-difference of scanning length correction amount for each laser beam is output from the correction amount calculating unit 1010 to the modulation unit 1007. As shown in FIG. 15, the modulation unit 1007 includes a PLL circuit 1201, a frequency division circuit 1202, a modulation circuit 1203, an output circuit 1204 and a counter circuit 1205. A base clock (base CLK) is input to the PLL circuit 1201, and the PLL circuit 1201 outputs a high frequency clock that is n times the base clock. This high frequency clock is input to the frequency division circuit 1202 and the output circuit 1204, respectively.

Figure 16:
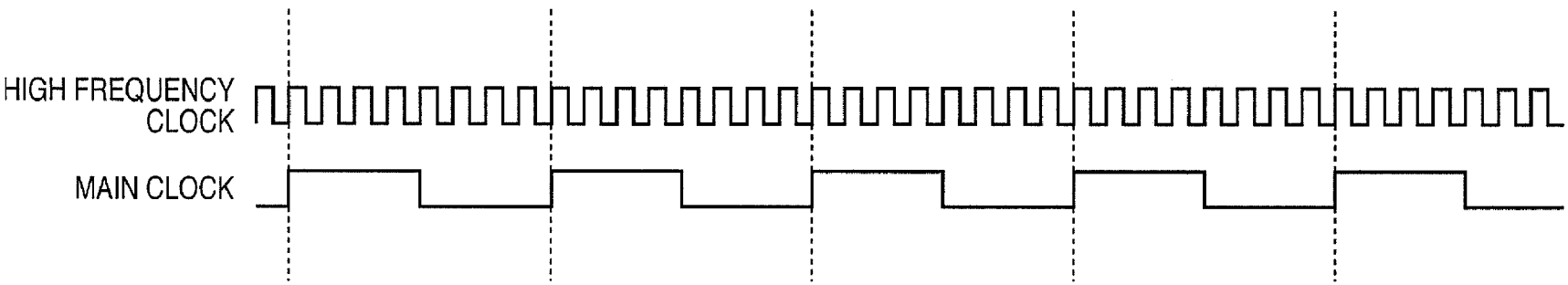
FIG. 16 is a timing chart showing an example of the operation of a frequency division circuit.

(Output of Frequency Division Circuit: FIG. 16)

The frequency division circuit 1202 of the modulation unit 1007 counts one time for x times of the input high frequency clocks and thereby outputs a main clock having a frequency divided a frequency of the input high frequency clock by 1/x (see FIG. 16). In this example, x may be any number as long as it is integer. To facilitate description, it is assumed that a main clock of the same period as the base clock divided by 1/n and inputted into the PLL circuit 1201 is output. FIG. 16 shows a main clock having a frequency divided a frequency of the high frequency clock by ⅛, which is made from eight high frequency clocks. A clock output from the frequency division circuit 61 is input into the counter circuit 1205.

Figure 17:
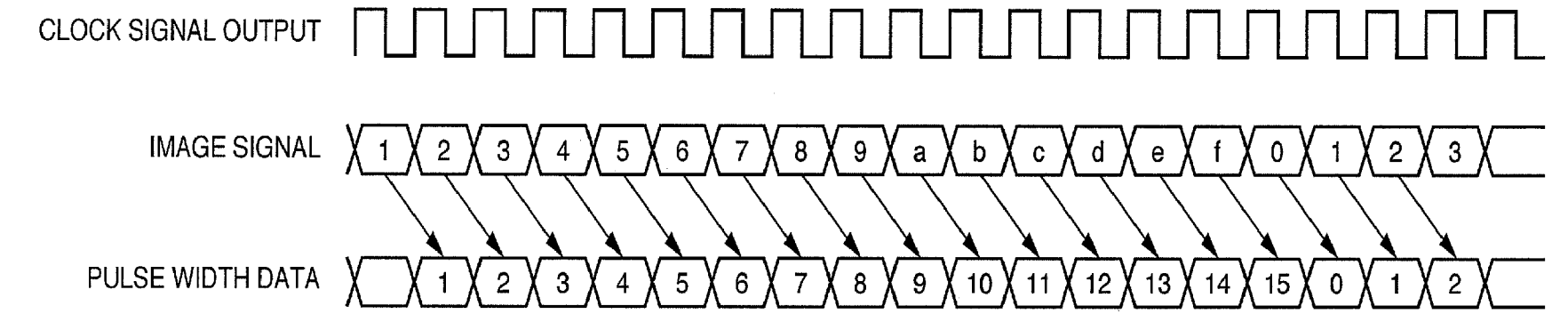
FIG. 17 is a timing chart showing an example of the operation of a modulation circuit.

(Output of Modulation Circuit: FIG. 17)

The modulation circuit 1203 of the modulation unit 1007 modulates image signals in synchrony with a clock signal that is described later. Normally, since the lighting time within a time unit is controlled by PWM modulation in order to represent the gradation characteristics of a laser, this embodiment is described assuming that PWM modulation (in particular, digital PWM modulation) is performed. For example, when performing PWM modulation of an image signal of A bits, the image signal is converted into pulse width data of $2^A$. In this example, the constant is determined so that the pulse width data of $2^A$ satisfies expression (3).

$$2^A=n \quad (3)$$

The modulation circuit 1203 generates pulse width data from the image signal and outputs the pulse width data to the output circuit 1204 (see FIG. 17).

Figure 18:
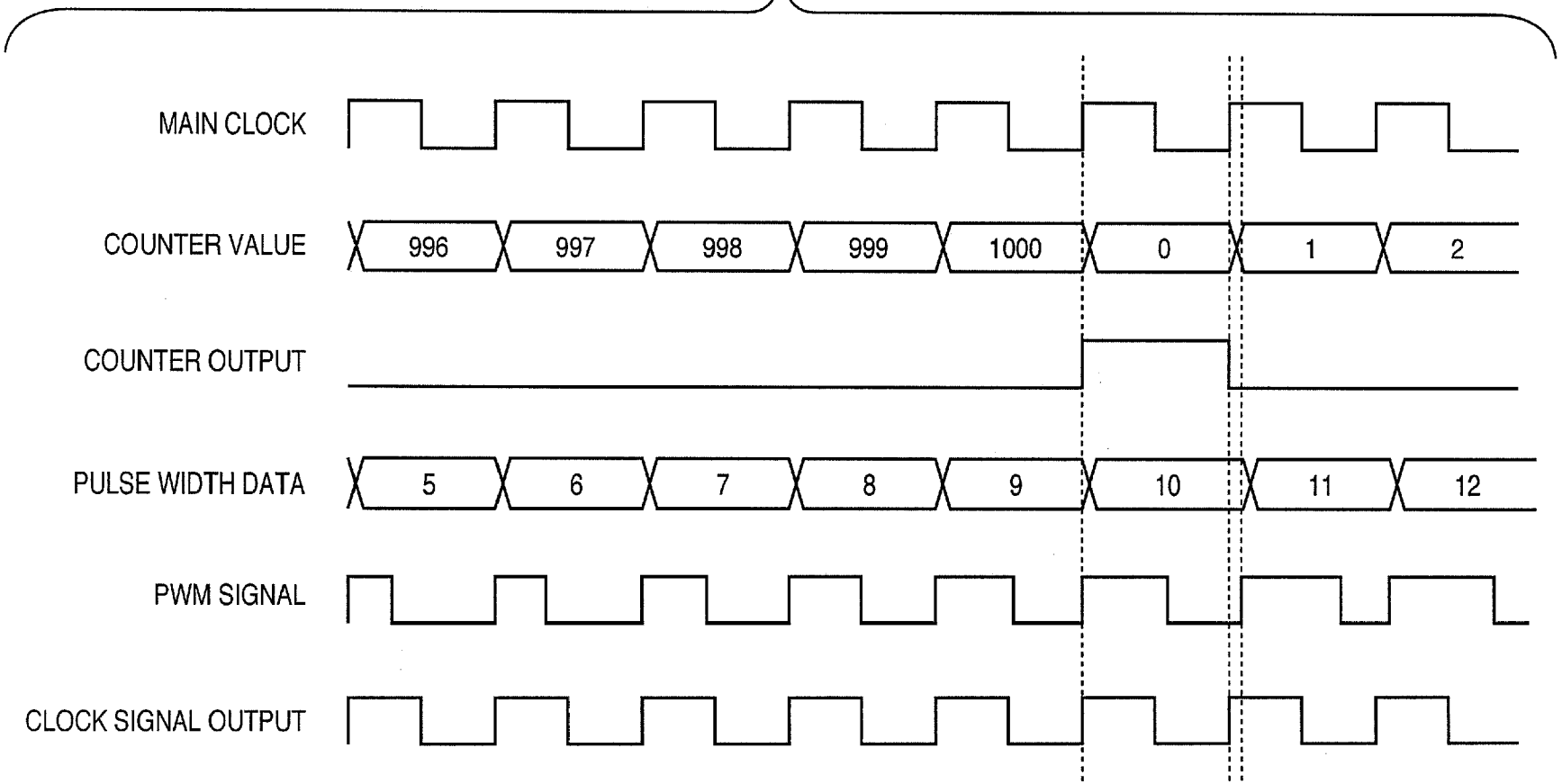
FIG. 18 is a timing chart showing an example of the operation of a counter circuit.

(Output of Output Circuit: FIG. 18)

In response to the pulse width data that was output from the modulation circuit 1203, the output circuit 1204 of the modulation unit 1007 outputs a clock signal synchronized with a high frequency clock and a PWM signal synchronized with a high frequency clock output from the PLL circuit 1201. The PWM signal is output to a laser driver 1008 and the clock signal is output to an image processing unit (not shown) and the modulation circuit 1203, respectively (see clock signal output, pulse width data, and PWM signal of FIG. 18).

The counter circuit 1205 counts (see count value of FIG. 18) the clock that is output from the frequency division circuit 1202 (clock having a frequency divided a frequency of the high frequency clock by 1/n: see main clock of FIG. 18). When the count value reaches a set value the counter circuit 1205 outputs a predetermined signal to the output circuit 1204 (see count value and counter output of FIG. 18). In this case, the value set in the counter circuit 1205 is a value determined in accordance with a value obtained by the above expression (1) at the correction value calculating unit 1010.

When the counter circuit 1205 outputs the aforementioned predetermined signal to the output circuit 1204, the output circuit 1204 performs an operation that is different to normal operation. More specifically, although in normal operation the output circuit 1204 generates a single period of a PWM signal and a clock signal output at n number of high frequency clocks, when the above described predetermined signal is input the output circuit 1204 outputs a PWM signal and a clock signal of a different period to the above described period (see pulse width data, PWM signal and clock signal output of FIG. 18). In the example shown in FIG. 18, in normal operation (when the counter output is low), the output circuit 1204 generates a PWM signal and a clock signal output from 8 high frequency clocks, and when the counter output is high, it generates a PWM signal and a clock signal output from 9 high frequency clocks.

Figure 19:
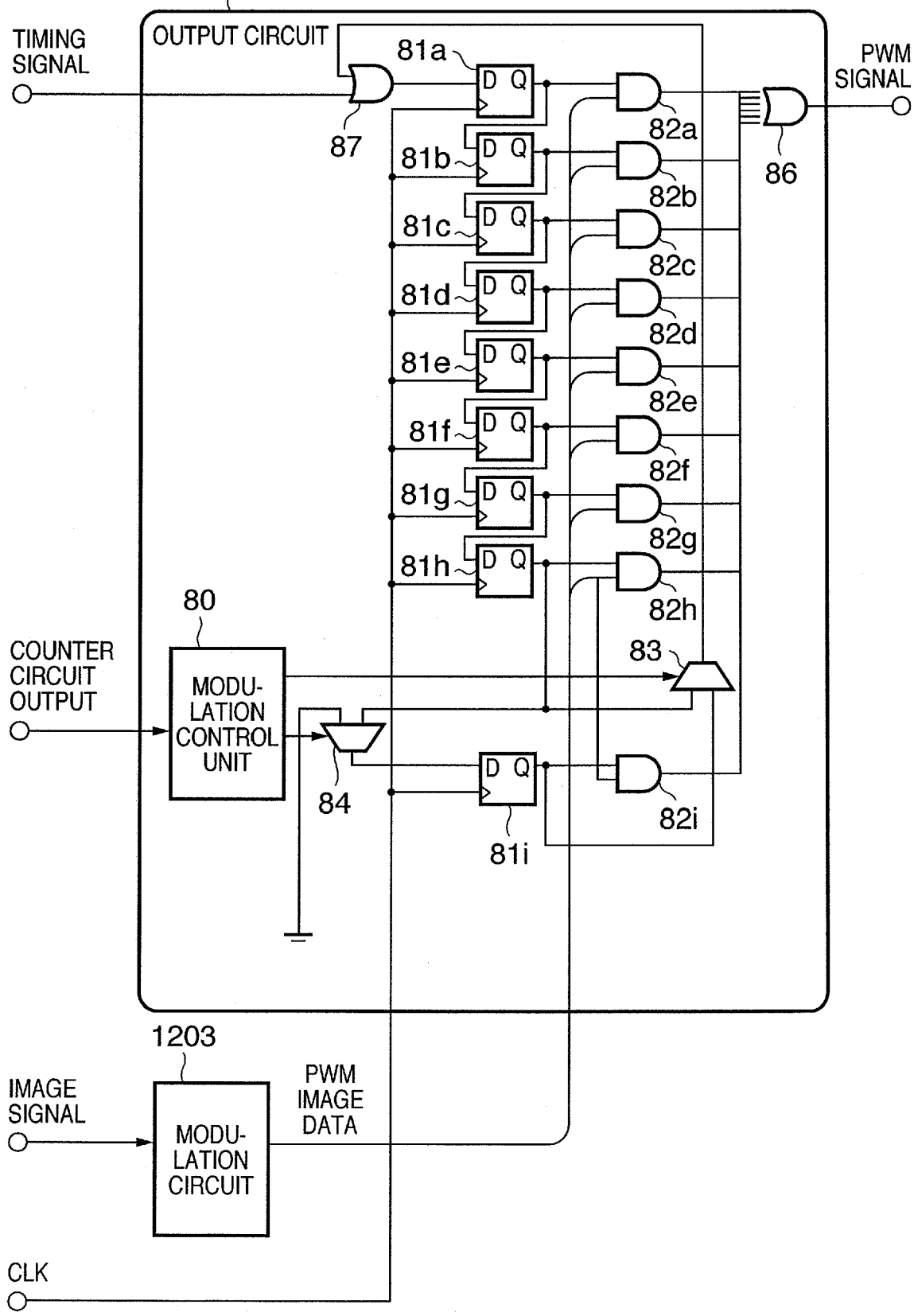
FIG. 19 is a view showing the configuration of an output circuit.

(Configuration Example of Output Circuit that Controls 8 Clock Widths and 9 Clock Widths: FIG. 19)

The specific configuration of the aforementioned output circuit 1204 will now be described. FIG. 19 is a block diagram that shows a detailed configuration of the output circuit 1204 shown in FIG. 15. As shown in FIG. 19, the output circuit 1204 includes a modulation control unit 80, nine D-type flip-flops 81*a* to 81*i*, nine two-input AND circuits 82*a* to 82*i*, two two-input selector circuits 83 and 84, a nine-input OR circuit 86, and a two-input OR circuit 87.

The modulation circuit 1203 modulates an input image signal into 8-bit pulse width data. Each bit of the pulse width data is input into one of the inputs of the two-input AND circuits 82*a* to 82*i*. In this case, the same data is input into the two-input AND circuits 82*h* and 82*i*.

The flip-flops 81*a* to 81*i* output the input of D terminal to Q terminal at the rising edge of the high frequency clock (CLK). The output of each of the flip-flops 81*a* to 81*i* is connected to the other input of the aforementioned two-input AND circuits 82*a* to 82*i*. At the same time, the flip-flops 81*a* to 81*i* are connected in tandem so that the output of flip-flop 81*a* is connected to the input of flip-flop 81*b*, the output of flip-flop 81*b* is connected to the input of flip-flop 81*c* and so on. Further, the output of flip-flop 81*h* is connected to the two-input selector circuit 83 and the two-input selector circuit 84. The output of flip-flop 81*i* is also connected to the two-input selector circuit 83.

The outputs of the two-input AND circuits 82*a* to 82*i* are each connected to the nine-input OR circuit 86, and the output of the nine-input OR circuit 86 is output as a PWM signal. The two-input selector circuit 83 selects an output of the flip-flops 81*h* to 81*i* in accordance with the output of the modulation control unit 80, and is connected to one of the inputs of the two-input OR circuit 87. The other input of the two-input selector circuit 84 is connected to a GND. The two-input selector circuit 84 controls whether or not to input the output of the flip-flop 81*h* into the flip-flop 81*i* depending on the output of the modulation control unit 80.

The modulation control unit 80 switches a select operation for the two-input selector circuits 83 and 84 in accordance with output of the counter circuit 64. A timing signal is input into the other input of the two-input OR circuit 87, and the output of the two-input OR circuit 87 is input into the flip-flop 81*a*.

Figure 20:
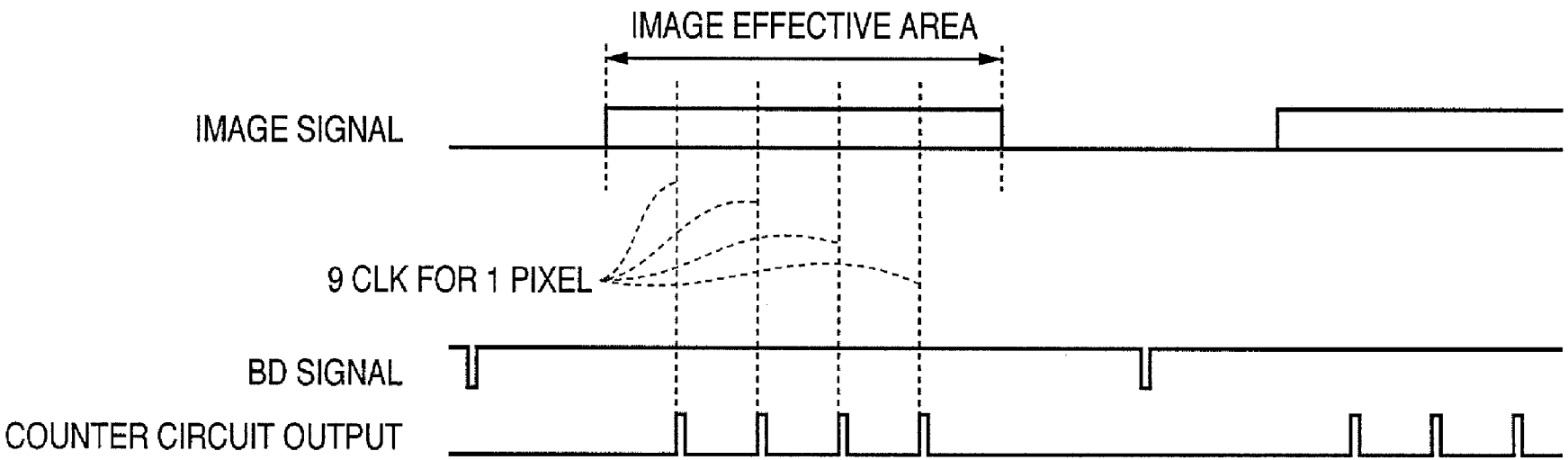
FIG. 20 is a timing chart showing an example of the operation of an output circuit.

(Operation Example of Output Circuit Shown in FIG. 19: FIG. 20)

Next, operation of the output circuit 1204 will be described referring to FIG. 20. FIG. 20 is a timing chart showing an operation example of the output circuit 1204 shown in FIG. 15. A timing signal synchronized with a high frequency clock (CLK) input into flip-flops 81*a* to 81*i* is input into the two-input OR circuit 87. This timing signal is a signal of a width of one clock of the high frequency clock. As a result, one output of a shift register of a ring comprising the flip-flops 81*a* to 81*i* is always "1".

Upon receiving the output of the counter circuit 64, the modulation control unit 80 switches the operations of the two-input selector circuits 83 and 84 so as to control the size of the above described ring-shaped shift register (i.e. the number of flip-flops constituting the ring-shaped shift register). When making one pixel with eight high frequency clocks (CLK), it selects the output of flip-flop 81*h* with the two-input selector circuit 83 and selects GND with the two-input selector circuit 84. When making one pixel with nine high frequency clocks (CLK), it selects the output of flip-flop 81*i* with the two-input selector circuit 83 and selects the output of flip-flop 81*h* with the two-input selector circuit 84. By means of this switching, "1" is output once in eight or nine high frequency clocks (CLK) as the output of the flip-flops 81*a* to 81*i*.

Pulse width data is set in the two-input AND circuits 82*a* to 82*i*, and that pulse width data changes for each pixel (=8 or 9 CLK). In each of the two-input AND circuits 82*a* to 82*i*, an AND operation is performed for the set data and the single "1" in the 8 or 9 high frequency clocks (CLK), and in the nine-input OR circuit 86, the AND output of each of the two-input AND circuits 82*a* to 82*i* is subjected to an OR operation. A PWM signal consisting of 8 or 9 high frequency clocks (CLK) is output as the result of this OR operation.

Although not shown in the figure, it is possible to use the same configuration to input an image clock pattern at a position corresponding to the image data, and output a clock signal that, similarly to the PWM signal, consists of 8 or 9 high frequency clocks (CLK). Further, by inputting the output of specific locations in the flip-flops 81*a* to 81*i* (for example, 81*a* and 81*e*) into a JK flip-flop circuit, a clock signal consisting of 8 or 9 high frequency clocks (CLK) can be output similarly to the PWM signal.

Thus, as shown in FIG. 20, control is carried out so that a single pixel is composed of nine high frequency clocks (CLK) at a specific location (write position) for each count in accordance with a correction amount calculated within one period (image effective area), and at other times a pixel is composed of eight high frequency clocks (CLK). By changing the number of pixels (output frequency) to be output with nine high frequency clocks in a period (image effective area) by means of this control, the difference of scanning length of each laser beam on the surface of the photosensitive drum 11 can be electrically corrected at periodical units of the high frequency clocks, and thus the scanning lengths produced by the four laser beams can be made equal to each other. Although in this embodiment a specific location that changes the width comprising one pixel is determined by the counter circuit 64, the location may also be determined, for example, by another timer means or the like.

As described in the foregoing, according to the image forming apparatus of this embodiment, even in a case in which the scanning incident angle of laser beams irradiated onto a photosensitive drum varies with each beam, it is possible to reduce a decline in image quality by simply correcting the variation in the main-scanning magnification of each beam that is produced by the difference in the scanning incident angle in the manner described above.

<Modification Example of Image Forming Apparatus of the Present Embodiment>

Another embodiment of the image forming apparatus will now be described. Since the image forming apparatus of this embodiment is similar to the image forming apparatus of the above described embodiment, in the following description only the points in which the image forming apparatus of this embodiment differs from the image forming apparatus of the above embodiment will be described.

Figure 12:
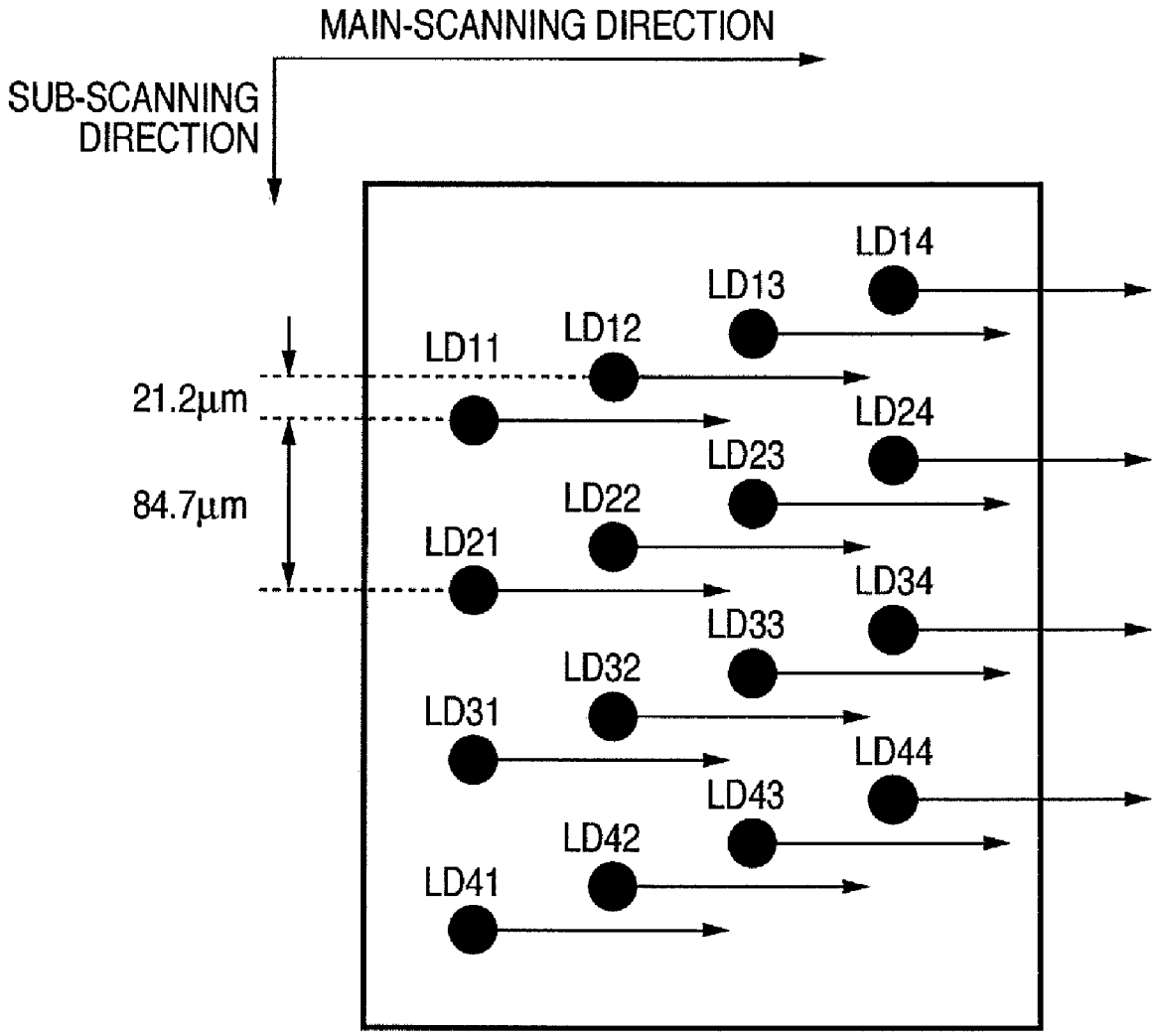
FIG. 12 is a view illustrating one example of a pattern of surface emitting laser beams according to the second embodiment.

(Features of Image Forming Apparatus of this Embodiment: FIG. 12)

According to the image forming apparatus of this embodiment, multiple surface-emission type beams that are disposed in a plurality in both the main-scanning direction and sub-scanning direction are used for the laser beams shown in one example in FIG. 12, and it is possible to perform correction processing that corrects main-difference of scanning lengths that occur when using these multiple beams.

The example shown in FIG. 12 includes a total of 16 laser beams, consisting of four rows in the main-scanning direction and four rows in the sub-scanning direction. The arrows in the figure represent the scanning directions. Four beams (for example, LD11, LD12, LD13, and LD14) that are disposed (arranged) in the main-scanning direction are aligned at a predetermined pitch (for example, 1200 dpi=21.2 μm) in the sub-scanning direction, and are aligned at a predetermined pitch (for example, ΔL2) in the main-scanning direction. Another four beams (for example, LD21, LD22, LD23, and LD24) that are disposed (arranged) in the main-scanning direction are similarly aligned. Further, as shown in the figure, four beams (for example, LD11, LD21, LD31, and LD41) that are disposed (arranged) in the sub-scanning direction are aligned at a predetermined pitch (for example, 21.2 μm×4=84.7 μm) in the sub-scanning direction. Another four beams (for example, LD12, LD22, LD32, and LD42) that are disposed (arranged) in the sub-scanning direction are similarly aligned. Thus, the scanning interval between the 16 laser beams in the sub-scanning direction is 1200 dpi=21.2 μm in each case.

With respect to the patterns for registration correction when using 16 laser beams as described above, in order to reduce toner, detection time, and correction processing time, patterns are only formed for the $1^{st}$ line and $16^{th}$ line. More specifically, patterns are formed such that a toner image is formed by only LD14 ($1^{st}$ line) and LD41 ($16^{th}$ line) that are disposed at the two ends in the sub-scanning direction in FIG. 12. In this case, the pitch interval in the sub-scanning direction between LD14 and LD41 is 21.2 μm×15=317.5 μm. Since it can be considered that the difference in the optical path length between adjacent beams is roughly equal, if the main-difference of scanning length between LD14 and LD41 is taken as ΔL1, the main-difference of scanning lengths between LD14 and LD13, LD13 and LD12, . . . LD42 and LD 41, will all be roughly 1/15*ΔL1. It is therefore possible to simply and accurately correct the main-scanning magnification (difference of scanning length) of each beam by the method of correction described in the above embodiment using this main-difference of scanning length (all roughly 1/15*ΔL1) from the $1^{st}$ line to the $16^{th}$ line.

In order to increase the degree of precision with respect to the main-difference of scanning lengths, correction may be performed for each group of four beams (LD11 to LD14, LD21 to LD24, LD31 to LD34, and LD41 to LD44) aligned in the main-scanning direction. More specifically, for the group consisting of LD11 to LD14, a pattern for main-scanning length correction may be formed with only the beams LD11 and LD14 that are disposed at each edge in the sub-scanning direction. Since it can be considered that the difference in the optical path length between adjacent beams is roughly equal, if the main-difference of scanning length between LD11 and LD14 is taken as ΔL2, all the main-difference of scanning lengths for the beams from LD11 to LD14 will be roughly (1/3×ΔL2). Similarly, for the beams LD21 to LD24, LD31 to LD34, and LD41 to LD44, patterns for main-scanning length correction may be formed with only the respective pairs of beams LD21 and LD24, LD31 and LD34, and LD41 and LD44 that are disposed at both edges in the sub-scanning direction. The values obtained by multiplying the respective detection results by 1/3 will be the main-difference of scanning lengths between the adjacent laser beams that are disposed between the laser beams in question. Thus, based on the above detection results, it is possible to accurately and simply perform main-scanning length correction for surface-emission type lasers by using the method of correcting described in the above embodiment.

This embodiment used means that controls a write position by changing the number of high frequency clocks that outputs one pixel as a correcting unit. However, a similar effect can also be obtained even when an image clock for forming an image with each laser beam is changed to use means that performs frequency modulation using PLL control. When the apparatus is changed in this manner, although the configuration shown in FIG. 13 does not change, the internal configuration of the image signal timing control unit 1006 and the modulation unit 1007 will be different. Although a modification example of the configuration of the modulation unit 1007 is not illustrated in the drawings, it can be configured by a known pulse width modulation circuit or the like.

Figure 21:
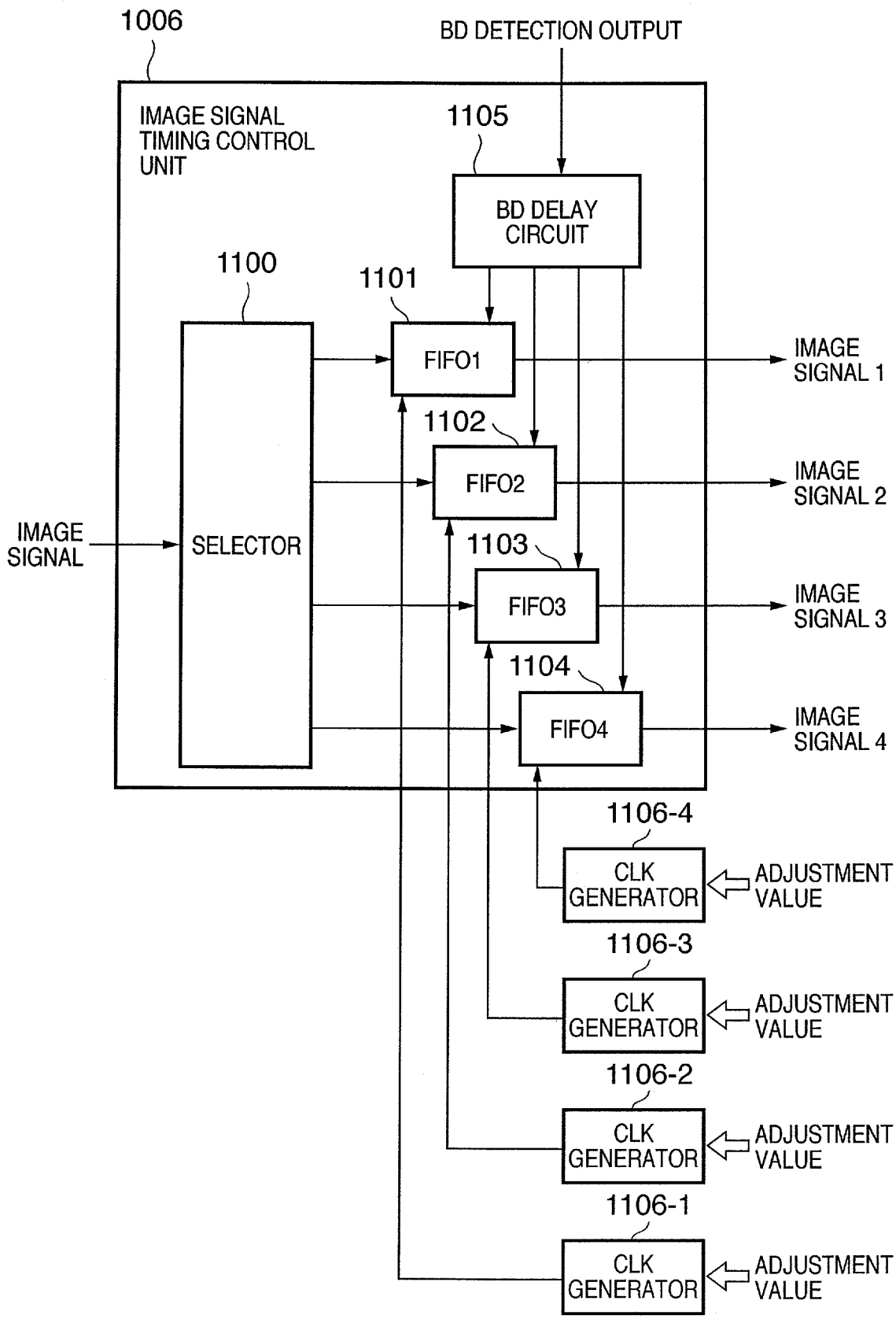
FIG. 21 is a view showing one example of an image signal timing control unit.

(Image Timing Control Unit: FIG. 21)

FIG. 21 shows the configuration of the image timing control unit according to the present modification example.

Image clocks that determine the image signal readout timing of FIFOs 1101 to 1104 are generated by CLK generators 1106-1 to 1106-4. The CLK generators 1106-1 to 1106-4 comprise a frequency modulation circuit that uses a known PLL control, and they determine the frequency of the CLKs generated using an external adjustment value. A value calculated based on a correction amount for a main-difference of scanning length is input into this adjustment value.

As described in the foregoing, correction of the main-scanning magnification of each beam can be accurately performed using a simple configuration without greatly changing the configuration of the conventional image forming apparatus. Further, even if the number of beams increases, the scale of the configuration for correcting main-difference of scanning lengths will not increase and the correction time will not become longer.

It is to be understood that the objects of the present invention may also be accomplished by a recording medium (or storage medium) on which a program code of software which realizes the functions of the above described embodiments is recorded. In this case, the objects of the present invention may also be accomplished by supplying a system or apparatus with the recording medium, and causing a computer (or CPU or MPU) of the system or apparatus to read out and execute the program code recorded on the recording medium. In this case, the program code itself read from the recording medium realizes the functions of the above described embodiments, and hence the program code and a recording medium on which the program code is recorded constitute the present invention.

Further, it is to be understood that the functions of the above described embodiments may be accomplished not only by executing a program code read out by a computer, but also by causing an OS (operating system) or the like which operates on the computer to perform a part or all of the actual operations based on instructions of the program code so that the functions of the foregoing embodiments can be implemented by this processing.

Further, it is to be understood that the functions of the above described embodiments may be accomplished by writing the program code read out from the recording medium into a memory provided in an expansion card inserted into a computer or a memory provided in an expansion unit connected to the computer and then causing a CPU or the like provided in the expansion card or the expansion unit to perform a part or all of the actual operations based on instructions of the program code.

Further, the invention present invention also includes a form in which program data for implementing the functions of the aforementioned embodiments is downloaded to the memory of a user's apparatus from a CD-ROM placed in the user's apparatus or an external supply source such as the Internet, to thereby implement the functions of the aforementioned embodiments.

When applying the present invention to the above described recording medium, a program code that corresponds to the above described flowcharts (FIG. 5 and FIG. 6) is preferably stored on the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-267694, filed on Sep. 14, 2005, which is hereby incorporated by reference herein in its entirety.

What is claimed is:

1. An image forming apparatus for forming an image by scanning on a photosensitive member in a main-scanning direction with a plurality of beams aligned in a sub-scanning direction, comprising:

a pattern forming unit adapted to form, with beams at both ends in the sub-scanning direction, patterns on the photosensitive member which are used for detecting a difference of scanning length in the main-scanning direction between the beams;

a position detection unit adapted to detect positions of a start point and an end point in the main-scanning direction of the patterns on the photosensitive member formed with the beams at both ends;

a difference of scanning length calculating unit adapted to calculate a difference of scanning length in the main-scanning direction between the beams at both ends based on the detected positions of the start and end positions on the photosensitive member;

a correction amount calculating unit adapted to calculate correction amounts for respectively correcting scanning lengths of the plurality of beams based on the calculated difference of scanning length between the beams at both ends; and a correcting unit adapted to correct scanning lengths of the plurality of beams respectively based on the calculated correction amounts, wherein, when a difference of scanning length in the main-scanning direction between the beams at both ends is taken as $\Delta L$ and the number of beams is taken as N, said correction amount calculating unit calculates a correction amount Li of a scanning length in a main-scanning direction of a beam located in the i-th position in the sub-scanning direction by $Li=\Delta L \times i/(N-1)$.

2. The image forming apparatus according to claim 1, wherein said correction amount calculating unit calculates the correction amount Li of the scanning length of the beam located in the i-th position in the sub-scanning direction, based on a difference $\Delta L$ of scanning length in the main-scanning direction between the beams at both ends and the curvature of the photosensitive member.

3. The image forming apparatus according to claim 1, wherein said correcting unit has a generating unit adapted to generate a pixel output signal formed by high frequency clocks having a frequency that is an integral multiple frequency of a pixel clock for a pixel signal, wherein a number of the high frequency clocks forming said pixel output signal is changed at a write position set based on the calculated correction amount in correspondence with each of the plurality of beams, and wherein a scanning length of each beam in the main-scanning direction is corrected by changing a number of pixel output signals in which the number of high frequency clocks is changed, within an image effective area in the main-scanning direction based on the calculated correction amount.

4. The image forming apparatus according to claim 3, wherein at a time of generating a pixel output signal in which the number of high frequency clocks is changed, said generating unit also generates a pixel clock in which the number of high frequency clocks is changed.

5. The image forming apparatus according to claim 1, wherein said correcting unit has a pixel clock generating unit adapted to generate a pixel clock having variable frequency, and corrects a scanning length of each beam in the main-scanning direction by changing a frequency of a pixel clock of each beam based on the calculated correction amount.

6. An image forming apparatus for forming an image by scanning a surface of a photosensitive member in a main-scanning direction with surface-emission type beams aligned in a sub-scanning direction and a main-scanning direction, comprising:

a pattern forming unit adapted to form, with at least beams at both ends in the sub-scanning direction, patterns on the photosensitive member which are used for detecting a difference of scanning length in the main-scanning direction between the beams;

a position detection unit adapted to detect positions of a start point and an end point in the main-scanning direction of the patterns on the photosensitive member formed with the beams at both ends;

a difference of scanning length calculating unit adapted to calculate a difference of scanning length in the main-scanning direction between the beams at both ends based on the detected positions of the start and end points on the photosensitive member;

a correction amount calculating unit adapted to calculate correction amounts for respectively correcting scanning lengths of the plurality of beams based on the calculated difference of scanning length between the beams at both ends;

a correcting unit adapted to correct scanning lengths of the plurality of beams respectively based on the calculated correction amounts, wherein, when a difference of scanning length in the main-scanning direction between the beams at both ends is taken as $\Delta L$ and the number of beams is taken as N, said correction amount calculating unit calculates a correction amount Li of a scanning length in a main-scanning direction of a beam located in the i-th position in the sub-scanning direction by $Li=\Delta L\times i/(N-1)$.

7. A method of controlling an image forming apparatus that forms an image by scanning on a photosensitive member in a main-scanning direction with a plurality of beams aligned in a sub-scanning direction, comprising the steps of:

forming, with beams at both ends in the sub-scanning direction, patterns on the photosensitive member which are used for detecting a difference of scanning length in the main-scanning direction between the beams;

detecting positions of a start point and an end point in the main-scanning direction of the patterns on the photosensitive member formed with the beams at both ends;

calculating a difference of scanning length in the main-scanning direction between the beams at both ends based on the detected positions of the start and end points on the photosensitive member;

calculating correction amounts for respectively correcting scanning lengths of the plurality of beams based on the calculated difference of scanning length between the beams at both ends; and correcting scanning lengths of the plurality of beams respectively based on the calculated correction amounts, wherein, when a difference of scanning length in the main-scanning direction between the beams at both ends is taken as $\Delta L$ and the number of beams is taken as N, the correction amount calculating step calculates a correction amount Li of a scanning length in a main-scanning direction of a beam located in the i-th position in the sub-scanning direction by $Li=\Delta L\times i/(N-1)$.

8. A method of controlling an image forming apparatus that forms an image by scanning on a photosensitive drum in a main-scanning direction with surface-emission type beams aligned in a sub-scanning direction and a main-scanning direction, comprising the steps of:

forming, with at least beams at both ends in the sub-scanning direction, patterns on the photosensitive member which are used for detecting a difference of scanning length in the main-scanning direction between the beams;

detecting positions of a start point and an end point in the main-scanning direction of the patterns on the photosensitive member formed with the beams at both ends;

calculating a difference of scanning length in the main-scanning direction between the beams at both ends based on the detected positions of the start and end points on the photosensitive member;

calculating correction amounts for respectively correcting scanning lengths of the plurality of beams based on the calculated difference of scanning length between the beams at both ends; and correcting scanning lengths of the plurality of beams respectively based on the calculated correction amounts, wherein, when a difference of scanning length in the main-scanning direction between the beams at both ends is taken as $\Delta L$ and the number of beams is taken as N, the correction amount calculating step calculates a correction amount Li of a scanning length in a main-scanning direction of a beam located in the i-th position in the sub-scanning direction by $Li=\Delta L\times i/(N-1)$.

* * * * *